US007246647B2

(12) United States Patent
Mullet et al.

(10) Patent No.: US 7,246,647 B2
(45) **Date of Patent: *Jul. 24, 2007**

(54) OVERHEAD DOOR LOCKING OPERATOR

(75) Inventors: Willis J. Mullet, Gulf Breeze, FL (US); Donald Bruce Kyle, Pace, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/507,910

(22) Filed: Aug. 21, 2006

(65) Prior Publication Data

US 2006/0278351 A1 Dec. 14, 2006

Related U.S. Application Data

(60) Continuation of application No. 11/041,840, filed on Jan. 24, 2005, now Pat. No. 7,143,804, which is a continuation of application No. 10/444,018, filed on May 22, 2003, now Pat. No. 6,851,465, which is a division of application No. 09/710,071, filed on Nov. 10, 2000, now Pat. No. 6,568,454, which is a continuation-in-part of application No. 09/548,191, filed on Apr. 13, 2000, now Pat. No. 6,561,255.

(51) Int. Cl.
*E05F 11/00* (2006.01)

(52) U.S. Cl. ..... 160/188; 49/200

(58) Field of Classification Search ..... 160/188, 160/189, 201, 133, 310; 49/139, 140, 199, 49/200; 74/625

See application file for complete search history.

(56) References Cited

U.S. PATENT DOCUMENTS 1,827,433 A 10/1931 Kendall
2,703,236 A 3/1955 Verdier
2,742,280 A 4/1956 Wilcox ..... 268/59

(Continued)

FOREIGN PATENT DOCUMENTS

DE 88 15 823 U 4/1989

(Continued)

*Primary Examiner*—David Purol
(74) *Attorney, Agent, or Firm*—Renner, Kenner, Greive, Bobak, Taylor & Weber

(57) ABSTRACT

A system for raising and lowering a sectional overhead door between an open position and a closed position including, a counterbalance system adapted to be connected to the door, an operator motor assembly mounted proximate to the sectional overhead door in the closed position of the sectional overhead door, at least a portion of the operator motor assembly movable between a door operating position and a door locking position, and a locking assembly (370) having an engaged position to hold the motor assembly in the operating position and a disengaged position to release the motor assembly allowing it to move to the door locking position. The system may be provided with a remote light assembly having a switchable light source in sensing communication with the operator motor such that operation of the motor activates the light source. The system is further provided with a handle assembly (515) operatively engaging the motor assembly (40) and counterbalance system (30) to selectively disconnect the motor assembly (40) from the counterbalance system (30), whereby urging of a rotatable handle (516) to a disconnect position (516') allows the door (D) to be manually freely moveable with the aid of the counterbalance system (30).

14 Claims, 15 Drawing Sheets

U.S. PATENT DOCUMENTS

| | | | | |
|---|---|---|---|---|
| 3,590,529 | A | 7/1971 | Purdy | |
| 4,085,629 | A | 4/1978 | Fogarollo | 74/625 |
| 4,098,023 | A | 7/1978 | Slopa | 49/139 |
| 4,167,833 | A | 9/1979 | Farina et al. | |
| 4,191,237 | A | 3/1980 | Voege | |
| 4,472,910 | A | 9/1984 | Iha | 49/139 |
| 4,598,238 | A | 7/1986 | Scarano | |
| 4,618,174 | A | 10/1986 | Duke | 292/135 |
| 4,852,706 | A | 8/1989 | Pietrzak et al. | 192/8 |
| 4,884,831 | A | 12/1989 | Emon | 292/38 |
| 4,941,320 | A | 7/1990 | Kersten et al. | |
| 4,954,810 | A | 9/1990 | Llewellyn | |
| 4,976,168 | A | 12/1990 | Lotznicker et al. | |
| 4,993,533 | A | 2/1991 | Brown | 192/114 |
| 5,419,010 | A | 5/1995 | Mullet | 16/198 |
| 5,509,233 | A | 4/1996 | Peterson | 49/139 |
| 5,538,205 | A | 7/1996 | Bitson | |
| 5,557,887 | A | 9/1996 | Fellows et al. | |
| 5,698,073 | A | 12/1997 | Vincenzi | |
| 5,931,212 | A | 8/1999 | Mullet | 160/188 |
| 6,179,036 | B1 | 1/2001 | Harvey | |
| 6,253,824 | B1 | 7/2001 | Mullet et al. | |
| 6,325,134 | B1 | 12/2001 | Mullet | |

FOREIGN PATENT DOCUMENTS

| | | | |
|---|---|---|---|
| DE | 93 10 534 | U | 10/1993 |
| EP | 0 939 189 | A | 9/1999 |
| WO | WO 99 07971 | A | 2/1999 |
| WO | WO 00 50720 | A | 8/2000 |

OVERHEAD DOOR LOCKING OPERATOR

CROSS-REFERENCE TO RELATED APPLICATION

This application is a continuation of prior application Ser. No. 11/041,840, filed on Jan. 24, 2005 now U.S. Pat. No. 7,143,804; which is a continuation of prior application Ser. No. 10/444,018, filed on May 22, 2003, and now U.S. Pat. No. 6,851,465; which is a divisional of patent application Ser. No. 09/710,071 filed on Nov. 10, 2000, and now U.S. Pat. No. 6,568,454; which is a continuation-in-part of patent application Ser. No. 09/548,191, filed on Apr. 13, 2000, and which is now U.S. Pat. No. 6,561,255.

TECHNICAL FIELD

The present invention relates generally to operators for sectional overhead doors. More particularly, the present invention relates to a type of "jack-shaft" operator for manipulating a sectional overhead door between the open and closed positions. More specifically, the present invention relates to a jack-shaft operator for a sectional overhead door which is highly compact, operates to lock the door in the closed position, and has a mechanical disconnect.

BACKGROUND ART

Motorized apparatus for opening and closing sectional overhead doors have long been known in the art. These powered door operators were developed in part due to extremely large, heavy commercial doors for industrial buildings, warehouses, and the like where opening and closing of the doors essentially mandates power assistance. Later, homeowners' demands for the convenience and safety of door operators resulted in an extremely large market for powered door operators for residential usage.

The vast majority of motorized operators for residential garage doors employ a trolley-type system that applies force to a section of the door for powering it between the open and closed positions. Another type of motorized operator is known as a "jack-shaft" operator, which is used virtually exclusively in commercial applications and is so named by virtue of similarities with transmission devices where the power or drive shaft is parallel to the driven shaft, with the transfer of power occurring mechanically, as by gears, belts, or chains between the drive shaft and a driven shaft, normally part of the door counterbalance system, controlling door position. While some efforts have been made to configure hydraulically or pneumatically-driven operators, such efforts have not achieved any substantial extent of commercial acceptance.

The well-known trolley-type door operators are attached to the ceiling and connected directly to the top section of a garage door and for universal application may be powered to operate doors of vastly different size and weight, even with little or no assistance from a counterbalance system for the door. Since the operating force capability of trolley-type operators is normally very high, force adjustments are normally necessary and provided to allow for varying conditions and to allow the operator to be adjusted for reversing force sensitivity, depending on the application. When a garage door and trolley-type operator are initially installed and both adjusted for optimum performance, the overhead door system can perform well as designed. However, as the system ages, additional friction develops in door and operator components due to loss of lubrication at rollers and hinges. Also, the door can absorb moisture and become heavier, and counterbalance springs can lose some of their original torsional force. These and similar factors can significantly alter the operating characteristics seen by the operator, which may produce erratic door operation such as stops and reversals of the door at unprogrammed locations in the operating cycle.

Rather than ascertaining and correcting the conditions affecting door performance, which is likely beyond a homeowner's capability, or engaging a qualified service person, homeowners frequently increase the force adjustment to the maximum setting. However, setting an operator on a maximum force adjustment creates an unsafe condition in that the operator becomes highly insensitive to obstructions. In the event a maximum force setting is effected on a trolley-type operator, the unsafe condition may also be dramatically exemplified in the event of a broken spring or springs. In such case, if the operator is disconnected from the door in the fully open position during an emergency or if faulty door operation is being investigated, one half or all of the uncounterbalanced weight of the door may propel the door to the closed position with a guillotine-like effect. Another problem with trolley-type door operators is that they do not have a mechanism for automatically disengaging the drive system from the door if the door encounters an obstruction. This necessitates the considerable effort and cost which has been put into developing a variety of ways, such as sensors and encoders, to signal the operator controls when an obstruction is encountered. In virtually all instances, manual disconnect mechanisms between the door and operator are required to make it possible to operate the door manually in the case of power failures or fire and emergency situations where entrapment occurs and the door needs to be disconnected from the operator to free an obstruction. These mechanical disconnects, when coupled with a maximum force setting adjustment of the operator, can readily exert a force on a person or object which may be sufficiently high to bind the disconnect mechanism and render it difficult, if not impossible, to actuate.

In addition to the serious operational deficiencies noted above, manual disconnects, which are normally a rope with a handle, must extend within six feet of the floor to permit grasping and actuation by a person. In the case of a garage opening for a single car, the centrally-located manual disconnect rope and handle, in being positioned medially, can catch on a vehicle during door movement or be difficult to reach due to its positioning over a vehicle located in the garage. Trolley-type door operators raise a host of peripheral problems due to the necessity for mounting the operator to the ceiling or other structure substantially medially of and to the rear of the sectional door in the fully open position.

Operationally, trolley-type operators are susceptible to other difficulties due to their basic mode of interrelation with a sectional door. Problems are frequently encountered by way of misalignment and damage because the connecting arm of the operator is attached directly to the door for force transmission, totally independent of the counterbalance system. Another source of problems is the necessity for a precise, secure mounting of the motor and trolley rails which may not be optimally available in many garage structures. Thus, trolley-type operators, although widely used, do possess certain disadvantages and, in certain instances, even dangerous characteristics.

The usage of jack-shaft operators has been limited virtually exclusively to commercial building applications where a large portion of the door stays in the vertical position. This occurs where a door opening may be 15, 20, or more feet in height, with only a portion of the opening being required for the ingress and egress of vehicles. These jack-shaft operators are not attached to the door but attach to a component of the counterbalance system, such as the shaft or a cable drum. Due to this type of connection to the counterbalance system, these operators require that a substantial door weight be maintained on the suspension system, as is the case where a main portion of the door is always in a vertical position. This is necessary because jack-shaft operators characteristically only drive or lift the door from the closed to the open position and rely on the weight of the door to move the door from the open to the closed position, with the suspension cables attached to the counterbalance system controlling only the closing rate.

Such a one-way drive in a jack-shaft operator produces potential problems if the door binds or encounters an obstruction upon downward movement. In such case, the operator may continue to unload the suspension cables, such that if the door is subsequently freed or the obstruction is removed, the door is able to free-fall, with the potential of damage to the door or anything in its path. Such unloading of the suspension cables can also result in the cables coming off the cable storage drums, thus requiring substantial servicing before normal operation can be resumed.

Jack-shaft operators are normally mounted outside the tracks and may be firmly attached to a door jamb rather than suspended from the ceiling or wall above the header. While there is normally ample jamb space to the sides of a door or above the header in a commercial installation, these areas frequently have only limited space in residential garage applications. Further, the fact that normal jack-shaft operators require much of the door to be maintained in a vertical position absolutely mitigates against their use in residential applications where the door must be capable of assuming essentially a horizontal position since, in many instances, substantially the entire height of the door opening is required for vehicle clearance during ingress and egress.

In order to permit manual operation of a sectional door in certain circumstances, such as the loss of electrical power, provision must be made for disconnecting the operator from the drive shaft. In most instances this disconnect function is effected by physically moving the drive gear of the motor out of engagement with a driven gear associated with the drive shaft. Providing for such gear separation normally results in a complex, oversized gear design which is not compatible with providing a compact operator which can feasibly be located between the drive shaft for the counterbalance system and the door. Larger units to accommodate gear design have conventionally required installation at or near the end of the drive shaft which may result in shaft deflection that can cause one of the two cables interconnecting the counterbalance drums and the door to carry a disproportionate share of the weight of the door.

Another common problem associated particularly with jack-shaft operators is the tendency to generate excessive objectionable noise. In general, the more components, and the larger the components, employed in power transmission the greater the noise level. Common operator designs employing chain drives and high speed motors with spur gear reducers are notorious for creating high noise levels. While some prior art operators have employed vibration dampers and other noise reduction devices, most are only partially successful and add undesirable cost to the operator.

Another requirement in jack-shaft operators is mechanism to effect locking of the door when it is in the closed position. Various types of levers, bars and the like have been provided in the prior art which are mounted on the door or on the adjacent track or jamb and interact to lock the door in the closed position. In addition to the locking mechanism which is separate from the operator there is normally an actuator which senses slack in the lift cables which is caused by a raising of the door without the operator running, as in an unauthorized entry, and activates the locking mechanism. Besides adding operational complexity, such locking mechanisms are unreliable and, also, introduce an additional undesirable cost to the operator system.

DISCLOSURE OF THE INVENTION

Therefore, an object of the present invention is to provide a motorized operator for a sectional door wherein a component of the operator is positioned proximate to the door to effect a locking function when the door reaches the closed position. Another object of the present invention is to provide such a motorized operator wherein the motor pivots into contact with the door to effect locking of the door in the closed position. A further object of the present invention is to provide such a motorized operator wherein a worm output of the motor and a driven worm wheel attached to the drive tube of a counterbalancing system remain in operative contact throughout the door operating cycle, thereby permitting the utilization of reduced size gears and permitting a smaller operator package. Still another object of the present invention is to provide such a motorized operator which does not require a locking mechanism or actuator therefore as components separate from the operator itself.

Another object of the present invention is to provide a motorized operator for sectional doors that has a disconnect that may be manually actuated from a location remote from the operator. A further object of the present invention is to provide such a motorized operator wherein actuation of the manual disconnect accomplishes both the separation of the operator from the counterbalance system and the unlocking of the door, whereby the door may be manually lifted from the closed position with assistance of the counterbalance system. A further object of the invention is to provide such an operator wherein the manual disconnect does not disturb the meshed relationship interconnecting the operator motor and the remainder of the drive gear system.

Another object of the present invention is to provide a motorized operator for sectional doors that eliminates the need for any physical attachment to the door in that it is mounted proximate to and operates through the counterbalance system and may be positioned at any location along the width of the door, preferably centrally thereof which case it could serve the dual purpose of a center support for the drive tube. A further object of the present invention is to provide such a motorized operator that may serve to reduce deflection of the counterbalance drive shaft to which it is directly coupled to provide prompt, direct feedback from any interruptions and obstructions which may effect the door during travel. Yet a further object of the invention is to provide such an operator which can be readily sized to fit within the area defined by the tracks at the sides of the door, the drive tube or drive shaft of the counterbalance system and the travel profile of the door, thereby requiring no more headroom or sideroom than a non-motorized door. Still another object of the invention is to provide such an operator which can be mounted in an area thus defined while moving between a non-interfering operating position and a locking position wherein a portion of the operator may physically engage the inner surface of the door proximate to the top. Still another object of the present invention is to provide such a motorized operator wherein a portion of the operator acts as a stop to movement of the top of the door relative to the header to create resistance to forced entry, air infiltration, water infiltration, and forces created by wind velocity pressure acting on the outside of the door.

Still another object of the present invention is to provide a motorized operator for sectional doors that does not require trolley rails, bracing for drive components, or any elements suspended from the ceiling or above the header or otherwise outside the area defined by the tracks, the counterbalance system and the door operating path. Yet another object of the present invention is to provide such an operator wherein the number of component parts is greatly reduced from conventional operators such as to provide improved reliability and quicker and easier installation. Yet another object of the invention is to provide such an operator which has fewer component parts subject to wear, requires less maintenance, achieves a longer operating life, while achieving quieter operation and less vibration due to a reduction in the number and size of rotating and other drive components.

In general, the present invention contemplates an operator for moving in upward and downward directions a sectional door having a counterbalancing system with a drive tube interconnected with the door including, a reversible motor, a drive gear selectively driven in two directions by the motor, a driven gear freely rotatably mounted on the drive tube and engaging the drive gear, a slide guide non-rotatably mounted on the drive tube, a disconnect mounted on the slide guide and selectively movable between a first position rotatably connecting the driven gear and the slide guide and a second position disconnecting the drive gear and the slide guide, and an actuator for selectively moving the disconnect between the first position and the second position.

PREFERRED EMBODIMENT FOR CARRYING OUT THE INVENTION

Figure 1:
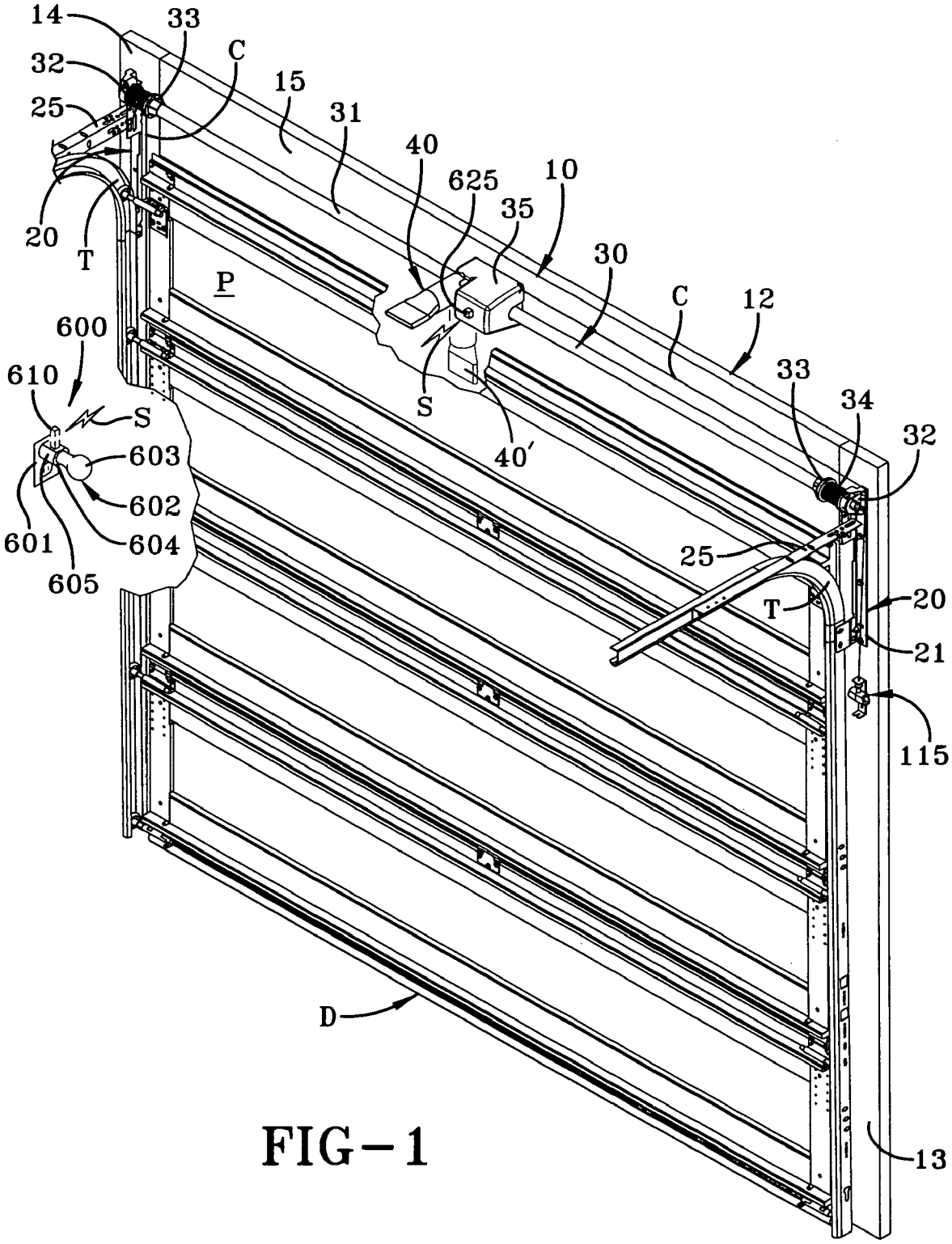
FIG. 1 is a rear perspective view of a sectional overhead garage door installation showing a motorized operator and remote light assembly according to the concepts of the present invention installed in operative relation thereto, with the operator depicted in its operating position in solid lines and the door locking position in chain lines and further schematically depicting transmission of a signal from the operator to the remote light assembly.

A motorized operator system according to the concepts of the present invention is generally indicated by the numeral 10 in the drawing figures. The operator system 10 is shown in FIG. 1 mounted in conjunction with a sectional door D of a type commonly employed in garages for residential housing. The opening in which the door D is positioned for opening and closing movements relative thereto is defined by a frame, generally indicated by the numeral 12, which consists of a pair of spaced jambs 13, 14 that, as seen in FIG. 1, are generally parallel and extend vertically upwardly from the floor (not shown). The jambs 13, 14 are spaced and joined at their vertically upper extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the operator system 10.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg 22 attached to an underlying jamb 13, 14 and a projecting leg 23 preferably disposed substantially perpendicular to the leg 22 and, therefore, perpendicular to the jambs 13, 14 (See FIG. 6).

Flag angles 20 also include an angle iron 25 positioned in supporting relation to tracks T, T located to either side of door D. The tracks T, T provide a guide system for rollers attached to the side of door D, as is well known to persons skilled in the art. The angle irons 25 normally extend substantially perpendicular to the jambs 13, 14 and may be attached to the transitional portion of tracks T, T between the vertical section and the horizontal section thereof or in the horizontal section of tracks T, T. The tracks T, T define the travel of the door D in moving upwardly from the closed to open position and downwardly from the open to closed position.

The operator system 10 may be electrically interconnected with a ceiling unit, which may contain a power supply, a light, a radio receiver with antenna for remote actuation of operator system 10 in a manner known in the art, and other operational peripherals. The ceiling unit may be electrically interconnected with a wall unit having an up/down button, a light control, and controls for other known functions.

Figure 2:
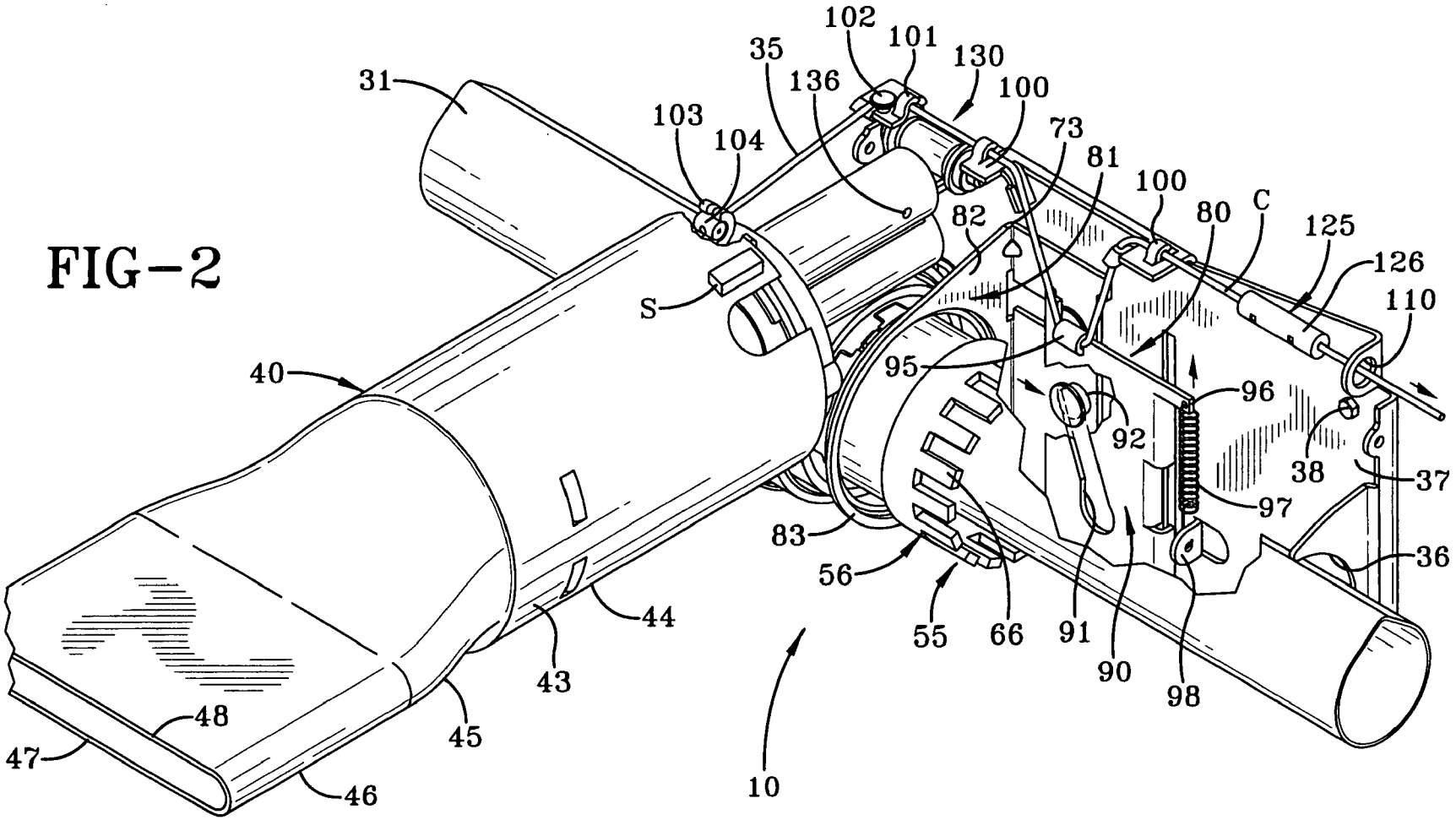
FIG. 2 is an enlarged perspective view of the motorized operator of FIG. 1 with the cover removed and portions broken away to show the mechanical interconnection of the motorized operator with the drive tube of the counterbalancing system.

Referring now to FIGS. 1 and 2 of the drawings, the operator system 10 mechanically interrelates with the door D through a counterbalance system, generally indicated by the numeral 30. As shown, the counterbalance system 30 includes an elongate drive tube 31 extending between tensioning assemblies 32, 32 positioned proximate each of the flag angles 20. While the exemplary counterbalance system 30 depicted herein is advantageously in accordance with U.S. Pat. No. 5,419,010, it will be appreciated by persons skilled in the art that operator system 10 could be employed with a variety of torsion-spring counterbalance systems. In any instance, the counterbalance system 30 includes cable drum mechanisms 33 positioned on the drive tube 31 proximate the ends thereof which rotate with drive tube 31. The cable drum mechanisms 33 each have a cable 34 reeved thereabout which is affixed to the door D preferably proximate the bottom, such that rotation of the cable drum mechanisms 33 operates to open or close the door D in conventional fashion.

As seen in FIGS. 1 and 2, the operator system 10 has an operator housing 35 which may conveniently enclose a length of the drive tube 31. While drive tube 31 is depicted as a hollow tubular member that is non-circular in cross-section, it is to be appreciated that circular drive tubes, solid shafts, and other types of driving elements that rotate cable drums, such as cable drum mechanisms 33, may be employed in conjunction with the operator system 10 of the instant invention and are encompassed within this terminology in the context of this specification.

The operator housing 35 has apertures 36 at either end through which drive tube 31 extends. Operator housing 35 has a mounting plate 37 that may be attached to the header 15 as by a plurality of cap screws 38 (FIG. 2). While operator housing 35 is shown mounted in relation to drive tube 31 substantially medially between the cable drum mechanisms 33, 33, it is to be noted that with the depicted counterbalance system 30, the operator housing 35 could be mounted at any desired location along drive tube 31 should it be necessary or desirable to avoid an overhead or wall obstruction in a particular garage design. Operatively, interrelated with the operator housing 35 is an operator motor assembly, generally indicated by the numeral 40. For purposes of powering the door D, the operator motor assembly 40 has an electric motor 41 constituting one of various types employed for overhead doors which is designed for stop, forward and reverse rotation of a motor shaft 42. As seen particularly in FIGS. 1, 2 and 4 the operator motor assembly 40 maybe provided with a motor cover 43. As shown, the motor cover 43 has a cylindrical portion 44 that overlies electric motor 41. Motor cover 43 may have an axial extension consisting of a truncated portion 45 of tapering dimensions terminating in an elongated oval portion 46 having flat parallel sides 47 and 48. The oval portion 46 of motor cover 43 has the flat side 47 positioned for engagement with the top of the top panel P of the door D when the operator motor assembly 40 is in the door locked position depicted in chain lines as 45 in FIG. 1. The wide, flat surface 47 may be advantageous in providing an enlarged contact area for locking engagement with the top of panel P to urge the panel P into contact with the header 15 to effect sealing engagement of panel P with the door frame 12. In the operating position of operator motor assembly 40 depicted in FIG. 1, the motor cover 43 extends only slightly above drive tube 31 and is essentially horizontally aligned with cable drum mechanisms 33, 33 and tensioning assemblies 32, 32 such as to remain vertically as well as laterally within the confines of the counterbalance system 30.

Figure 3:
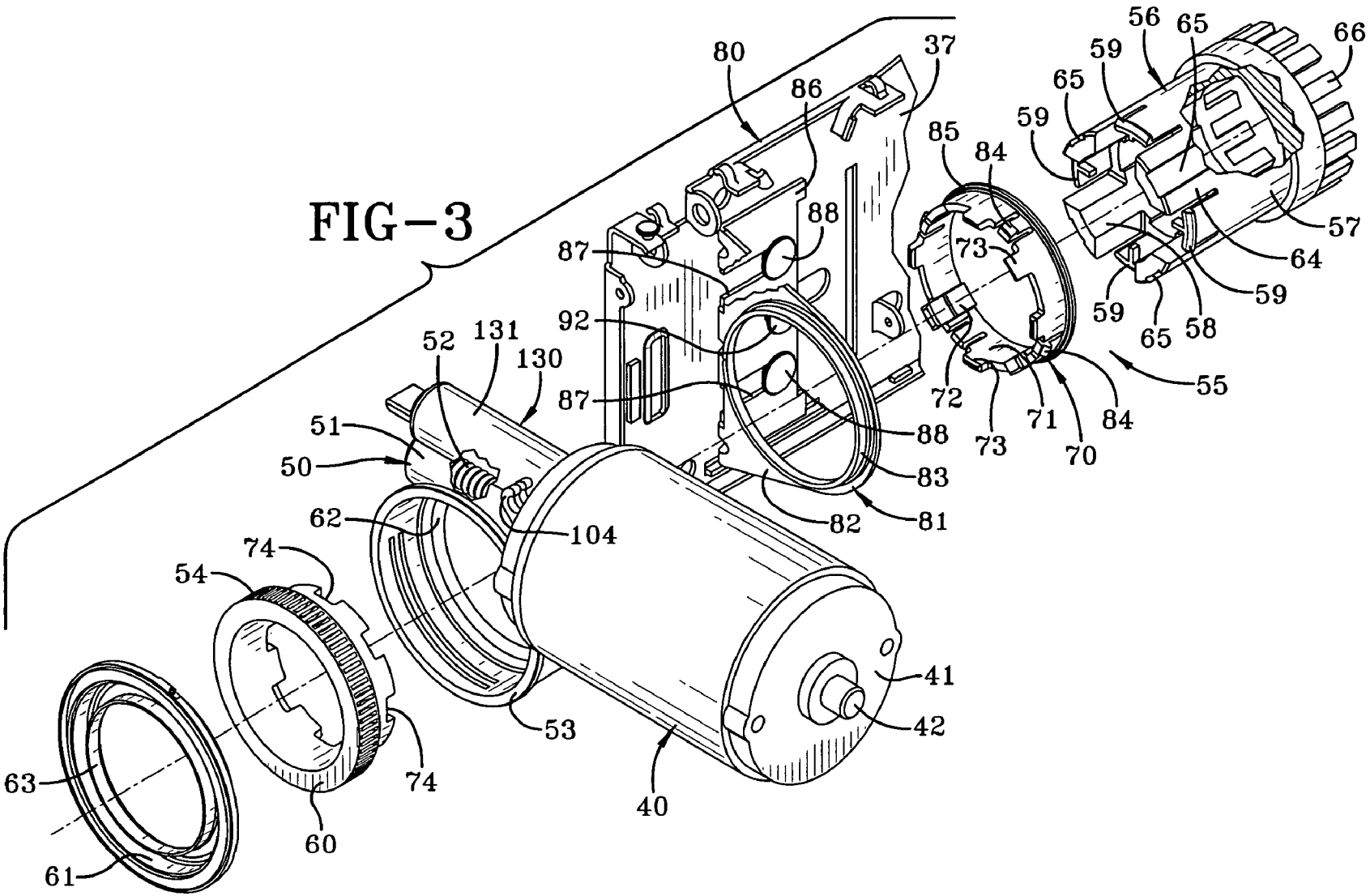
FIG. 3 is a further enlarged exploded perspective view showing details of the drive system and the disconnect assembly.
Figure 4:
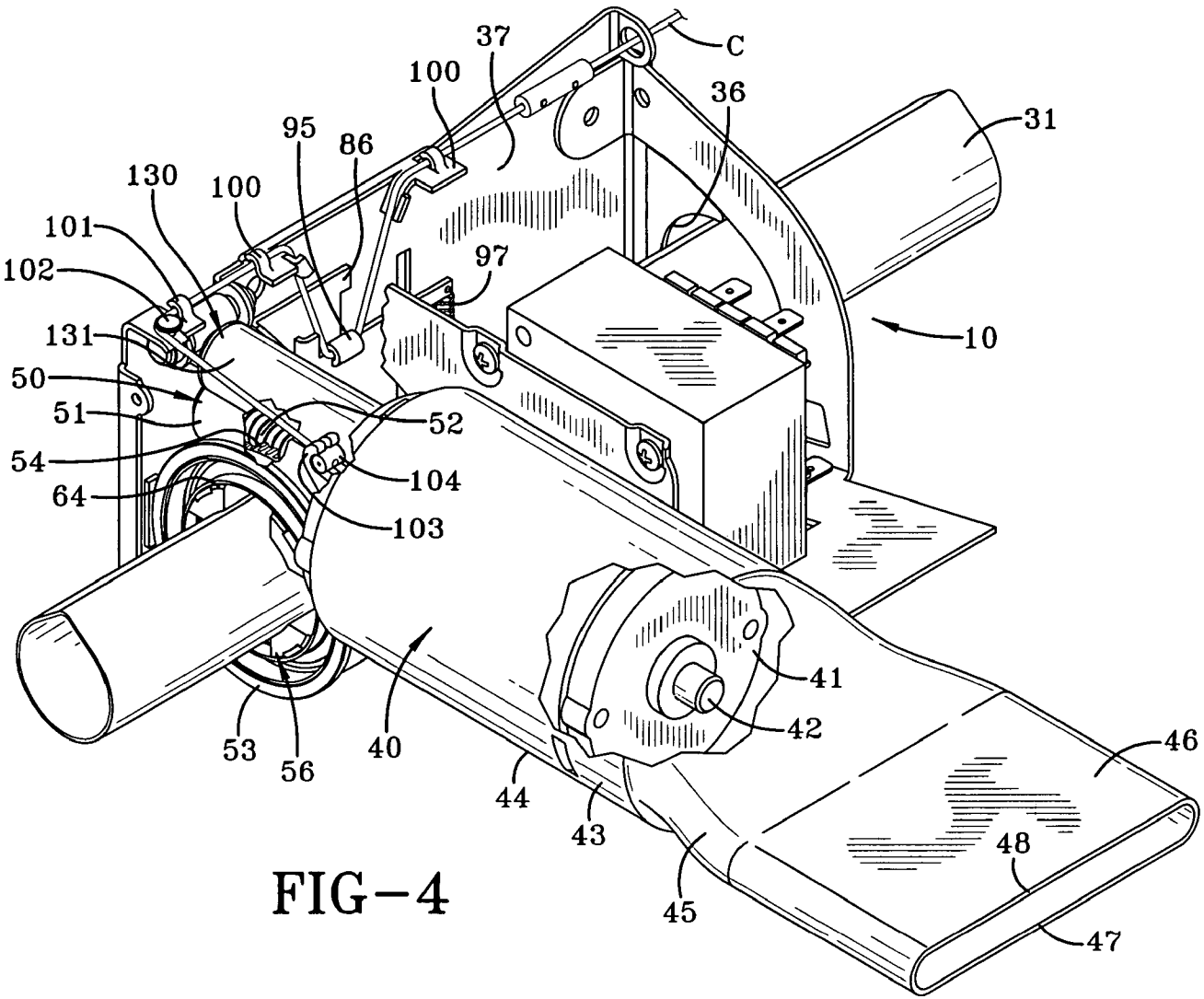
FIG. 4 is a further enlarged perspective view of the motorized operator of FIG. 1 with portions of the cover broken away to show additional details of the drive elements and the disconnect assembly.

Referring particularly to FIGS. 3 and 4, a drive train enclosure, generally indicated by the numeral 50, projects from the motor cover 43 in the direction opposite the truncated portion 45 thereof. The drive train enclosure 50 has a hollow cylindrical extension portion 51 which extends from motor cover 43. The cylindrical portion 51 of drive train enclosure 50 accommodates a worm 52 which is attached to or may be cut into the shaft 42 of motor 41. The drive train enclosure 50 also includes an open-ended cylindrical journal 53 which intercommunicates through the wall thereof with the interior of cylindrical portion 51 of drive train enclosure 50 and particularly with the worm 52 reposing therein. As best seen in FIGS. 3 and 4, the journal 53 seats internally thereof a worm wheel 54 which is at all times positioned in mating engagement with the worm 52 of electric motor 41.

The drive tube 31 of counterbalance system 30 is selectively rotationally driven by motor 41 through a drive tube drive assembly, generally indicated by the numeral 55. The drive tube drive assembly 55 includes a slide guide, generally indicated by the numeral 56, which is a generally elongate, cylindrical member that has a substantially circular outer surface 57 that freely rotatably mounts the worm wheel 54 positioned within the drive train enclosure 50. The slide guide 56 has internal surfaces 58 that are non-circular and, in cross section, substantially match the out of round configuration of the drive tube 31. Thus, the slide guide 56 and drive tube 31 are non-rotatably interrelated, such that drive tube 31 moves rotationally with slide guide 56 at all times. The slide guide 56 is maintained at a fixed position axially of the drive tube 31 by interengagement with the drive train enclosure 50 and worm wheel 54. Proximate the axial extremity of the circular outer surface 57 of slide guide 56 are a plurality of spring catches 59. As shown, there are four spring catches 59, which are equally spaced about the outer periphery of the outer surface 57 of slide guide 56. When the slide guide 56 is positioned inside worm wheel 54, the spring catches 59 abut the axial surface 60 of the worm wheel 54.

The drive tube drive assembly 55 also includes an end cap 61 that interfits within the cylindrical journal 53 of the drive train enclosure, as best seen in FIG. 4. Thus, the spring catches 59 of slide guide 56 are interposed between and thus axially restrained by axial surface 60 of worm wheel 54 and the end cap 61. Movement of the worm wheel 54 in an axial direction opposite the end cap 61 is precluded by a radially in-turned flange 62 in the cylindrical journal 53 of drive train enclosure 50. The end cap 61 has a radial inner rim 63 that serves as a bearing surface for the axially outer surface of circular outer surface 57 of slide guide 56 that extends axially beyond the spring catches 59 (see FIGS. 3 and 4).

The circular outer surface 57 of slide guide 56 has circumferentially-spaced, axial-extending grooves 65 for a purpose to be detailed hereinafter. The axial extremity of slide guide 56 opposite the axial outer surfaces 64 may be provided with encoder notches 66 to generate encoder signals representative of door position and movement for door control system functions of a type known to persons skilled in the art.

Drive tube drive assembly 55 has a disconnect sleeve, generally indicated by the numeral 70, which is non-rotatably mounted on, but slidable axially of, the slide guide 56. As best seen in FIG. 3, the disconnect sleeve 70 has a generally cylindrical inner surface 71 that is adapted to slidingly engage the circular outer surface 57 of slide guide 56. The inner surface 71 has one or more tabs 72 that are inwardly raised, axially-extending surfaces, which are adapted to matingly engage the axially-extending grooves 65 of slide guide 56. Thus, when disconnect sleeve 70 is mounted on slide guide 56, with tabs 72 engaging the grooves 65, the disconnect sleeve 70 is free to slide axially of slide guide 56 but is precluded from relative rotation. The axially extremity of disconnect sleeve 70, which faces the worm wheel 54 has a plurality of circumferentially-spaced, projecting teeth 73, as seen in FIGS. 2 and 3. The teeth 73 selectively engage and disengage spaced circumferential recesses 74 in the axial extremity of worm wheel 54 opposite the axial surface 60.

The selective engagement and disengagement of the disconnect sleeve 70 with the worm wheel 54 is controlled by a disconnect actuator, generally indicated by the numeral 80. The disconnect actuator 80 has a disconnect bracket, generally indicated by the numeral 81. The disconnect bracket 81 is generally L-shaped, with a triangular projection 82 that has a ring-shaped receiver 83 that seats the disconnect sleeve 70. The disconnect sleeve 70 has circumferentially-spaced, radially-outwardly extending catches 84 that engage one axial side of ring-shaped receiver 83. The disconnect sleeve 70 also has a flange 85 at the axial extremity opposite the teeth 73 and catches 84, such as to maintain disconnect sleeve 73 axially affixed to receiver 83 but freely rotatable relative thereto.

The disconnect bracket 81 has a right angle arm 86 relative to the triangular projection 82, which is movably affixed to the mounting plate 37 of operator housing 35. As best seen in FIG. 3, the arm 86 has a pair of spaced lateral slots 87 through which headed lugs 88 project to support the disconnect bracket 81 and limit its motion to an axial direction whereby the disconnect bracket 81 moves the disconnect sleeve 70 directly axially into and out of engagement with the worm wheel 54.

The disconnect actuator 80 also has a disconnect plate 90 which overlies the disconnect bracket 81, as best seen in FIG. 2. The disconnect plate 90 has a downwardly and laterally oriented slot 91 which receives a headed lug 92 which is affixed to the arm 86 of disconnect bracket 81. It will thus be appreciated that the component of lateral movement affected by upward or downward displacement of disconnect plate 90 is transmitted via lug 92 to lateral motion of the disconnect bracket 81 on lugs 88 to axially displace disconnect sleeve 70 in and out of engagement with worm wheel 54.

Still referring to FIG. 2, the vertical movement of disconnect plate 90 of disconnect actuator 50 to move disconnect sleeve 70 from the engaged position depicted upwardly as indicated by the arrows toward the disengage position is effected by a cable C. The disconnect plate 90 has a guide loop 95 which slidably engages the cable C. The disconnect plate 90 has a projecting arm 96 to which one end of a tension spring 97 is connected. The other end of tension spring 97 is attached to a fixed tab 98 which, as shown, maybe formed in the mounting plate 37 of operator housing 35. It is to be appreciated that the spring 97 eliminates any slack in the cable C while biasing disconnect plate 90 downwardly as viewed in FIG. 2 to continually urge the disconnect sleeve 70 toward engagement with worm wheel 54.

The cable C is positioned to permit adjustment upon vertical movement of guide loop 95 by a pair of cable guides 100 which may be attached to or, as shown, formed from mounting plate 37 of operator housing 35. One run of cable C is directed to a further cable guide 101 and around a pivot pin 102 which affects a redirection toward the operator motor assembly 40. The cylindrical portion of 44 of motor cover 43 has a bifurcated hook 103 which retains an end pin 104 on the end of cable C. The other run of cable C extends through an aperture 110 in mounting plate 37 of operator housing 35 (FIG. 2).

Figure 6:
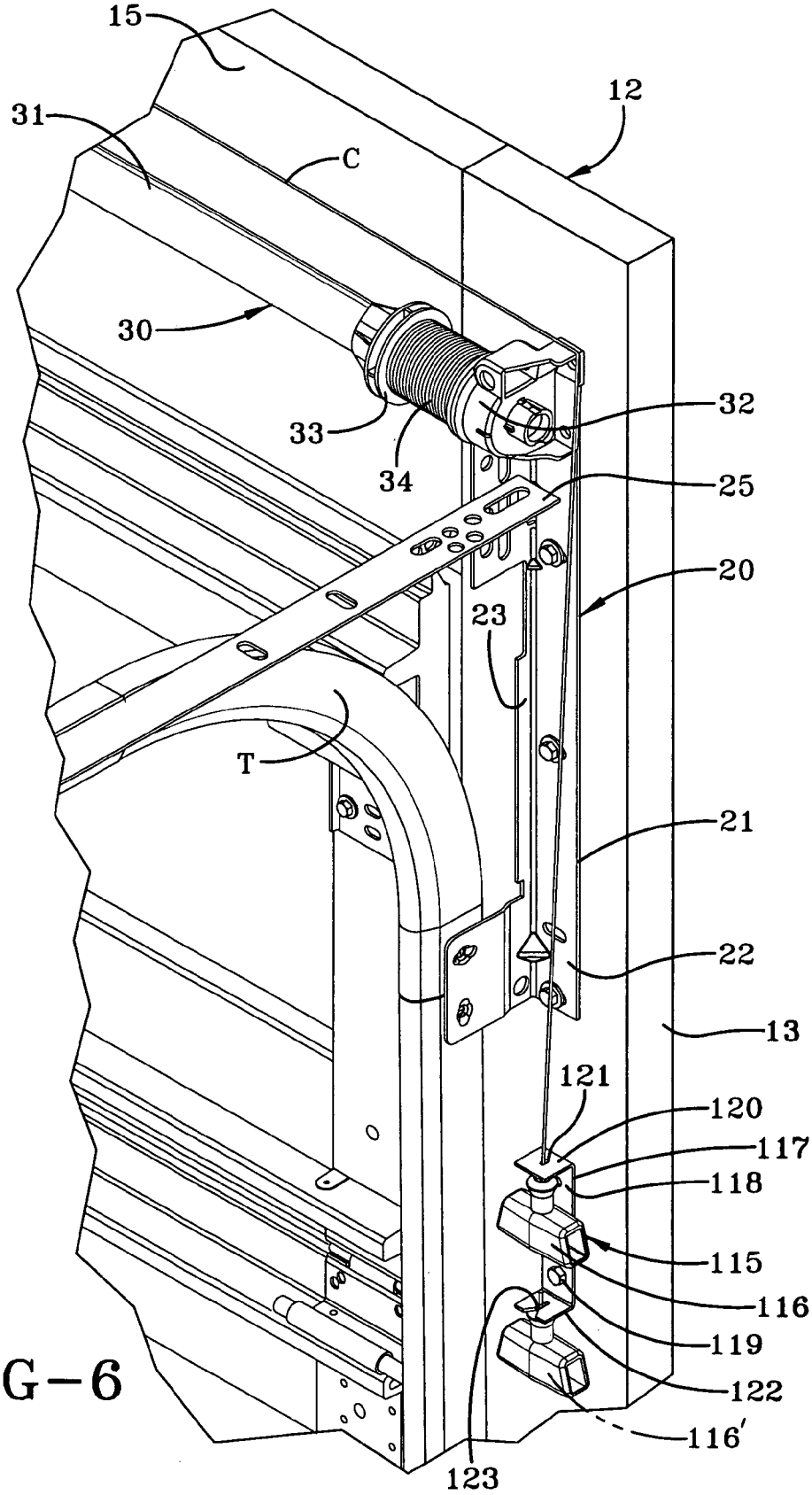
FIG. 6 is an enlarged fragmentary portion of the sectional overhead door installation of FIG. 1 showing details of the placement and structure of the manual disconnect assembly.

Referring to FIGS. 1 and 6, the cable C is routed over a tensioning assembly 32 of counterbalance system 30 to a handle assembly, generally indicated by the numeral 115. The handle assembly 115 includes a T-shaped handle 116 which terminates the cable C. Handle assembly 115 also includes a U-shaped plate 117 having a base 118 which may be affixed to a door jamb 13 as by a cap screw 119, or other suitable fastener, at a location which is convenient for disconnecting the door but sufficiently displaced from windows in the door D or in the garage structure to preclude actuation of the handle 116 by a potential intruder outside the garage. Handle 116 may further be located to facilitate its operation when a vehicle or other articles centrally within the garage or to otherwise prevent the handle 115 from damaging, interfering, or becoming entangled with articles within the garage. The U-shaped plate 117 has an outwardly projecting arm 120 with a bore 121 sized to freely receive the cable C but serving as a stop for T-shaped handle 116 with the cable tensioned and the disconnect actuator 80 in the position depicted in FIG. 2 with the disconnect sleeve 70 engaging the worm wheel 54. U-shaped plate 117 has a second projecting arm 122 having a V-shaped slot 123 therein. As seen in FIG. 6 the T-shaped handle 116 may be pulled downwardly to reside in a second position 116' with the cable inserted in V-shaped slot 123. At such time, the operator motor assembly 40 is in the operate position, i.e. substantially perpendicular to the door D, and the disconnect actuator 80 is moved to the disengage position where the disconnect sleeve 70 is out of engagement with the worm wheel 54. Thus, in the second position of T-shaped handle 116', the operator motor assembly 40 is in the operating position and the drive tube drive assembly 55 has disconnected the motor 41 and the drive tube 31, such that the door D can be freely manually raised or lowered as assisted by the counterbalance system 30.

The run of cable C which extends out of the operator housing 35 may include an anti-intrusion member, generally indicated by the numeral 125. As best seen in FIG. 2 the anti-intrusion member consists of a cylindrical cable crimp 126 which is attached to the cable C. As can be seen in FIG. 2 the cable crimp 126 is positioned within the operator housing 35 and is spaced a short distance from aperture 110 when the disconnect actuator 80 is in the engaged position with the disconnect sleeve 70 in engagement with the worm wheel 54. If the handle assembly 115 is operated by pulling downwardly so that cable C proximate the aperture 110 is displaced directly axially, the cable crimp 126, which has a lesser diameter than the aperture 110, moves freely through the aperture 110 to affect the disconnect function. However, in the event of an attempted unauthorized entry, as through a window in the door D, a displacement of cable C by reaching inwardly and upwardly and pulling downwardly on the cable C will advance the cable C and cable crimp 126 other than directly axially, such that the cable crimp 126 will engage housing 35 in the area surrounding aperture 110 and thus preclude movement of the cable C sufficient to carry out a movement of the disconnect sleeve to a position where it is disengaged from worm wheel 54.

Figure 5:
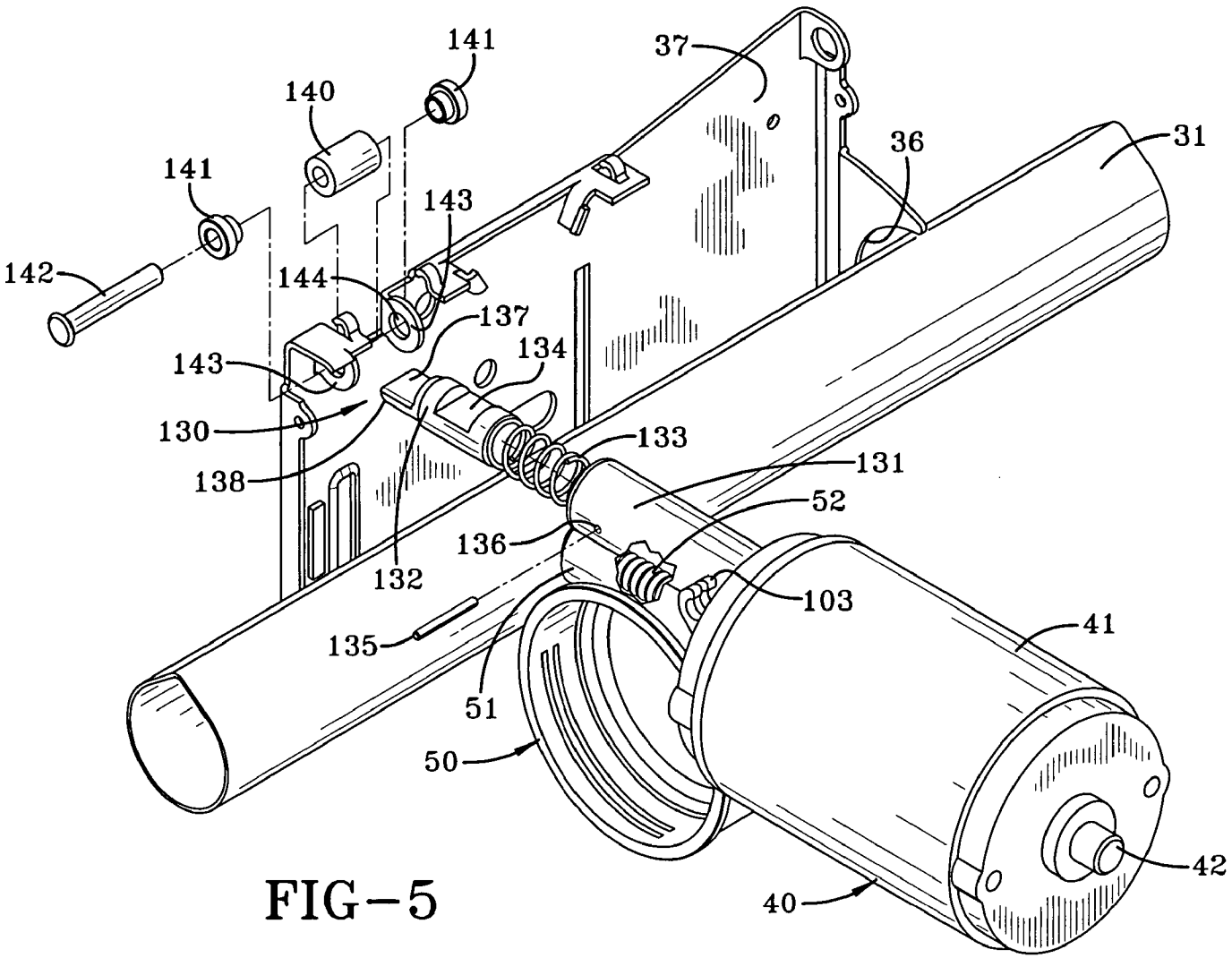
FIG. 5 is an exploded perspective view showing details of operative components of the retaining assembly which selectively secures the operator in the door operating position.

The operator motor assembly 40 is selectively secured in the door operating position during the normal torque range attendant the moving of door D in upward and downward directions by a motor retaining assembly generally indicated by the numeral 130. As seen in FIGS. 3-5, the motor retaining assembly 130 includes a tubular projection extending from motor cover 43 and which may be adjacent to the drive train enclosure 50. Tubular projection 131 and houses a plunger 132 which is biased outwardly of tubular projection 131 by a compression spring 133. The plunger 132 is maintained within tubular projection 131 and its axial throw therein is controlled by a slot 134 in the plunger 132 which receives a pin 135 extending through bores 136 in the tubular projection 131. The projecting extremity of plunger 152 has a flat contact surface 137 which terminates in a rounded extremity 138.

The plunger 132 of motor retaining assembly 130 collectively operatively engages a fixed cylindrical stop 140. The stop 140 is mounted between a pair of friction washers 141 on a shaft 142 as is seen in detail in FIG. 5. The shaft 142 supporting cylindrical stop 140 is retained by a pair of spaced ears 143 having bores 144 supporting the shaft 142. As shown, the ears may be formed in the mounting plate 37 of operator housing 35. As may be appreciated from FIGS. 2, 4 and 5 of the drawings, the flat contact surface 137 of plunger 132 underlies the cylindrical stop 140 with the door in the operating position. The plunger 132 pivots away from the fixed cylindrical stop when the operator motor assembly 40 is in the locked position depicted in chain lines at 40' in FIG. 1. When moving from the locked position to the operating position, the operator motor assembly 40 moves upwardly until the rounded extremity 138 of plunger 132 engages the cylindrical stop 40 which commences compression of the spring 133. When operator motor housing 40 reaches the operating position depicted at 40 in FIG. 1 in a position substantially perpendicular to the door D, the engaging surface 138 as urged by spring 133 rotates cylindrical stop 140 such that the flat contact surface 137 is positioned under the cylindrical stop 140. The flat contact surface 137 moves out from under roller 130 when sufficient torsional forces are placed upon operator motor assembly 40, thereby releasing from the motor retaining assembly 130.

Figure 7:
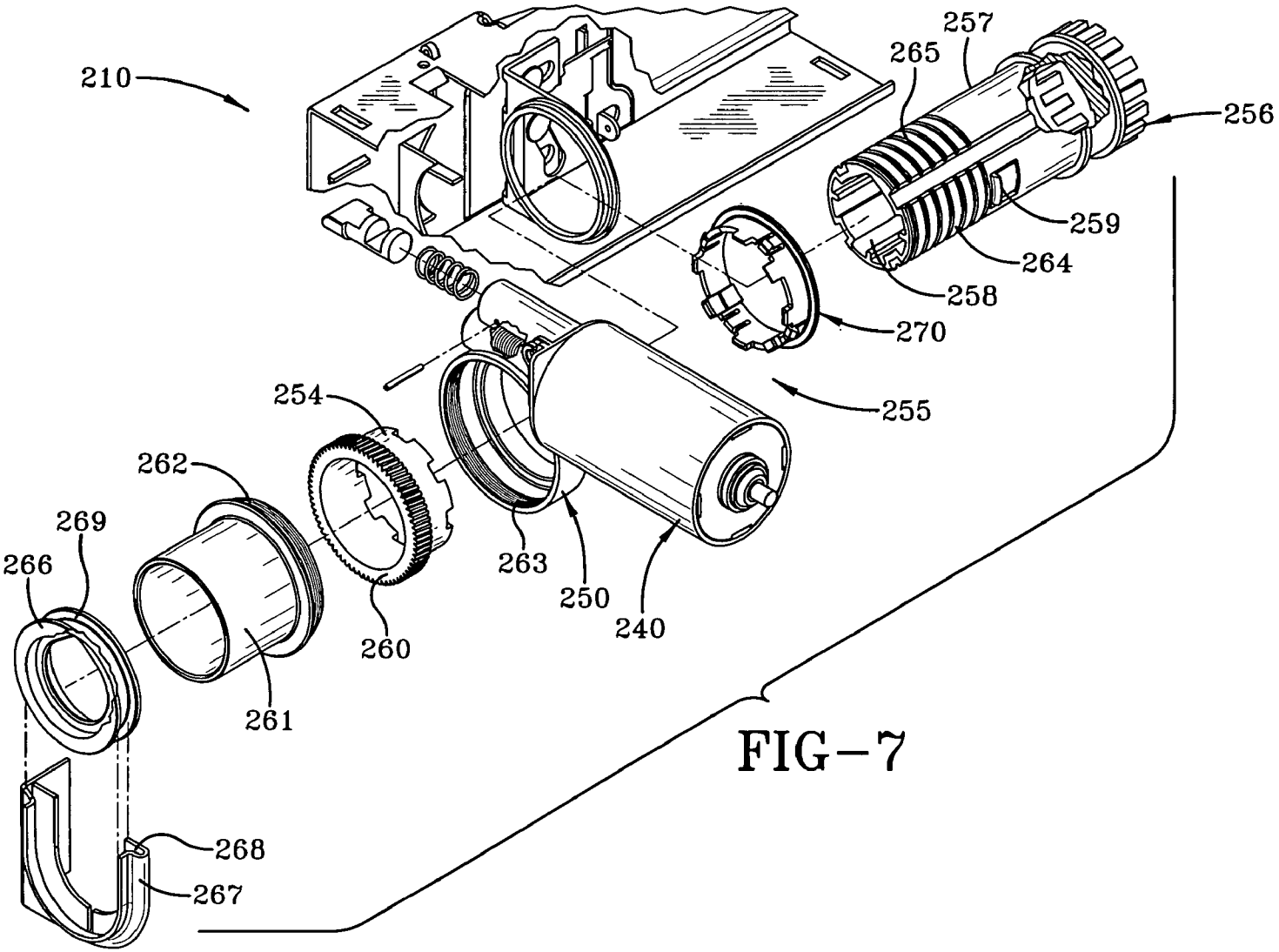
FIG. 7 is an enlarged exploded perspective view showing details of an alternate embodiment of drive tube drive assembly according to the concepts of the present invention.
Figure 8:
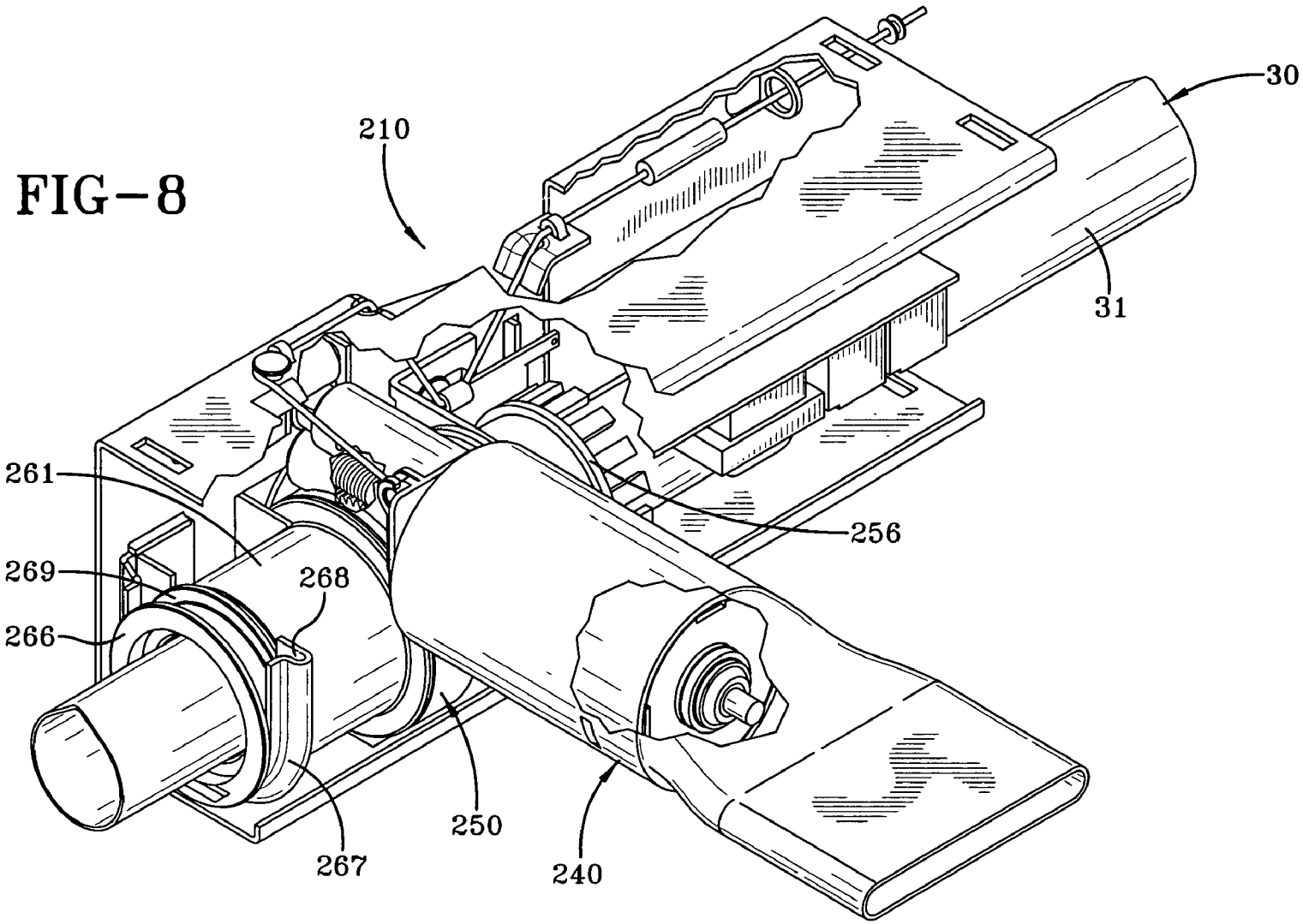
FIG. 8 is a perspective view of the motorized operator of the alternate embodiment of FIG. 7 with the gear removed to show the mechanical interconnection of the motorized operator with the drive tube of the counterbalancing system in the assembled configuration.

In instances of wider or heavier doors D, an alternative embodiment operator system 210 shown in FIGS. 7 and 8 maybe provided. Operator system 210 may have an operator motor assembly, generally indicated by the numeral 240, which may be essentially identical to the operator motor assembly 40. Operator system 210 also has a drive train enclosure, generally indicated by the numeral 250, which may be substantially similar to the drive train enclosure 50 and interact with a counterbalance system 30 and drive tube 31 constructed as described hereinabove.

The differences in operator system 210 reside primarily in the drive tube drive assembly, generally indicated by the numeral 255. As best seen in FIG. 7, drive tube drive assembly 255 includes a slide guide, generally indicated by the numeral 256, which is a generally elongate cylindrical member that has a substantially circular outer surface 257 that freely rotatably mounts the worm wheel 254 positioned within the drive train enclosure 250. The slide guide 256 has internal surfaces 258 that are non-circular and, in cross section, substantially match the outer out-of-round configuration of the drive tube 31. Thus the slide guide 256 and drive tube 31 are non-rotatably interrelated, such that drive tube 31 moves rotationally with slide guide 256 at all times. The slide guide 256 is maintained in a fixed position axially of the drive tube 31 by interengagement with the drive train enclosure 250 and the worm wheel 254. The circular outer surface 257 of slide guide 256 has one or more spring catches 259 which extend outwardly of the outer surface 257. When the slide guide 256 is positioned inside worm wheel 254 within drive train enclosure 250 the spring catch 259 abuts the axially outer surface 260 of the worm wheel 254.

An elongate bearing sleeve 261 having external threads 262 is threaded into internal threads 263 in the drive train enclosure 250. Once threaded into position, the bearing sleeve 261 receives the cylindrical extension 264 on slide guide 256. The cylindrical extension 264 maybe provided with spaced circumferential grooves 265 which reduce contact area and thus friction between cylindrical extension 264 and bearing 261, while providing stabilization by contact over a substantial length. The extremity of bearing sleeve 261 opposite the threads 262 is supported in a bushing 266 as best seen in FIG. 7. A U-shaped wall support 267 having a groove 268 for receiving a flange 269 on bushing 266 maintains the bearing sleeve 261 in a fixed anchored position. A disconnect sleeve, generally indicated by the numeral 270 is structured and interacts with the slide guide 256 in the manner of the disconnect sleeve 70 described hereinabove. It will thus be appreciated that in operator system 210 the operator motor assembly 240 is supported to either side of drive train enclosure 250, i.e., through the disconnect sleeve 270 and the bearing sleeve 261.

In the operation of both embodiments of the invention when the door D is closing the operator motor assembly 40 is in the operating position depicted in FIG. 1 with the disconnect sleeve 70 engaging the worm wheel 54 so that motor 41 is releasing cable 34 from the counterbalance system 30. At this time the motor retaining assembly 130 maintains the operator motor assembly 40 in the operating position. When the door D reaches the closed position the torque of motor 41 tends to rotate the operator motor assembly 40 about the drive tube 41 such that the rotational resistance provided by motor retaining assembly 130 is overcome, whereby the flat contact surface 137 of plunger 132 rotates away from the fixed cylindrical stop 140. Continued operation of motor 41 rotates the operator motor assembly 40 through approximately 90 degrees until the motor cover 43 engages the top panel P of the door D to thereby lock the door D in the closed position. The torsional resistance provided by the door D is sensed by controls of operator motor assembly 40 and operation of motor 41 is discontinued.

Figure 9:
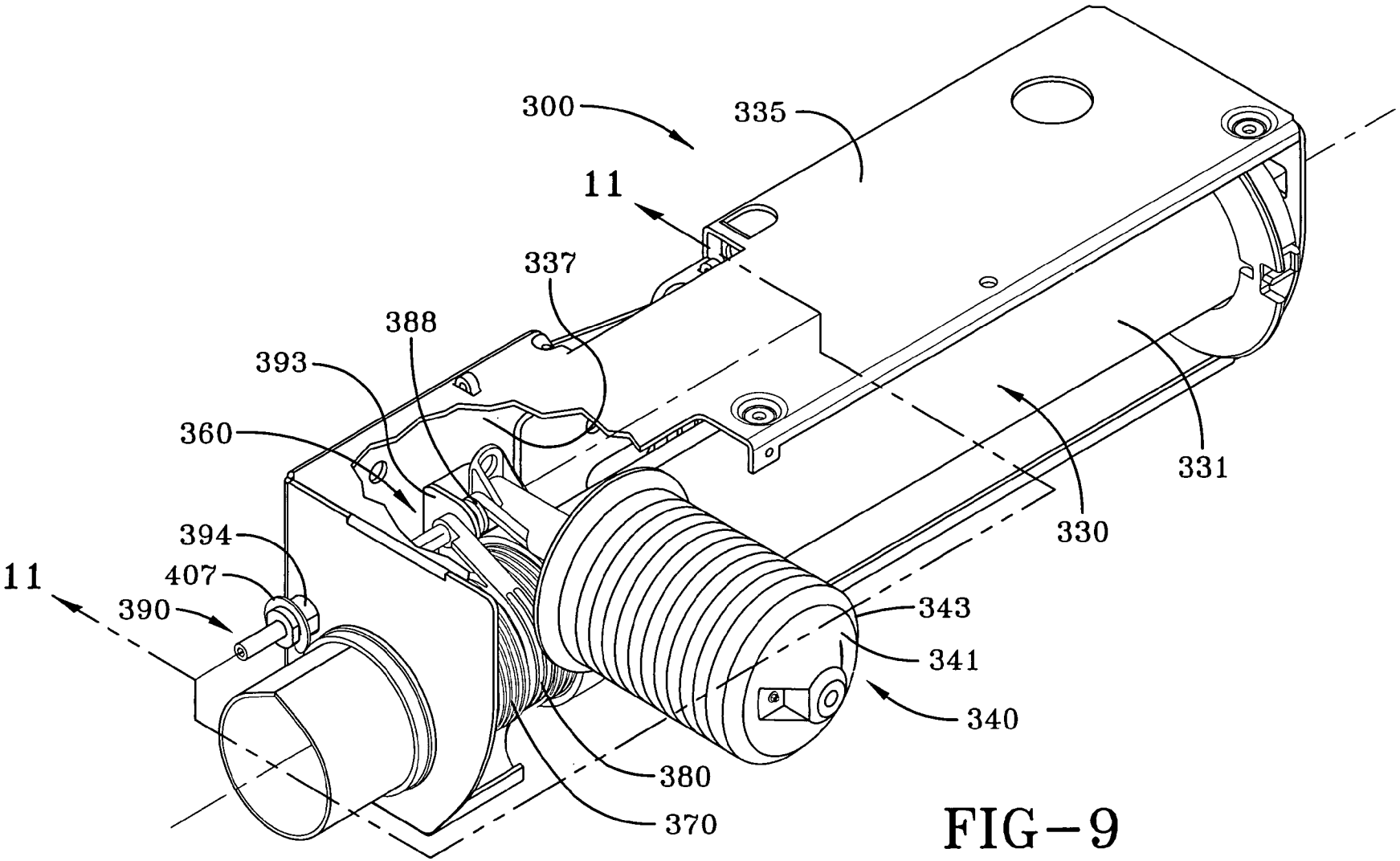
FIG. 9 is a perspective view of a motorized operator system having a modified form of locking assembly.

In another embodiment of the invention a motorized operator is generally indicated by the numeral 300 in the figures. The operator system 300 shown in FIG. 9 is mounted in conjunction with a sectional door D (FIG. 1). Similar to the prior embodiments, operator system 300 may be electrically interconnected with a ceiling unit, which may contain a power supply, a light, a radio receiver with antenna for remote actuation of operator system 300 in a manner known in the art, and other operational peripherals. In further similarity to the prior embodiments, operator system 300 mechanically interrelates with the door D through a counterbalance system, generally indicated by the numeral 330. As previously described in other embodiments, the counterbalance system 330 includes an elongate drive tube 331 extending between tensioning assemblies positioned proximate each of the flag angles.

As seen in FIG. 9, the operator system 300 has an operator housing 335 enclosing a length of the drive tube 331. The operator housing 335 has apertures 336, 336 (FIG. 10) at either end through which drive tube 331 extends. The operator housing 335 further has a mounting plate 337 that may be attached to the header as by a plurality of cap screws. Operatively, interrelated with the operator housing 335 is an operator motor assembly, generally indicated by the numeral 340. For purposes of powering the door D, the operator motor assembly 340 includes an electric motor designed for stop, forward, and reverse rotation of a motor shaft. The motor assembly 340 may be provided with a motor cover 343. In the operating position of operator motor assembly 340 depicted in FIG. 9, the motor cover 343 extends only slightly above drive tube 331 and is essentially horizontally aligned with cable drum mechanisms and tensioning assemblies such as to remain vertically as well as laterally within the confines of the counterbalance system 330.

As previously described, if unrestrained, the torque developed by operation of motor assembly 340 tends to urge the motor assembly 340 toward a locked position similar to 40' of FIG. 1, which potentially could cause the motor assembly 340 to interfere with the travel of the door D along its prescribed path. As discussed in previous embodiments, a motor restraining assembly, such as a latch, magnet or detent may be used to retain the motor assembly 340 in the operation position.

Figure 10:
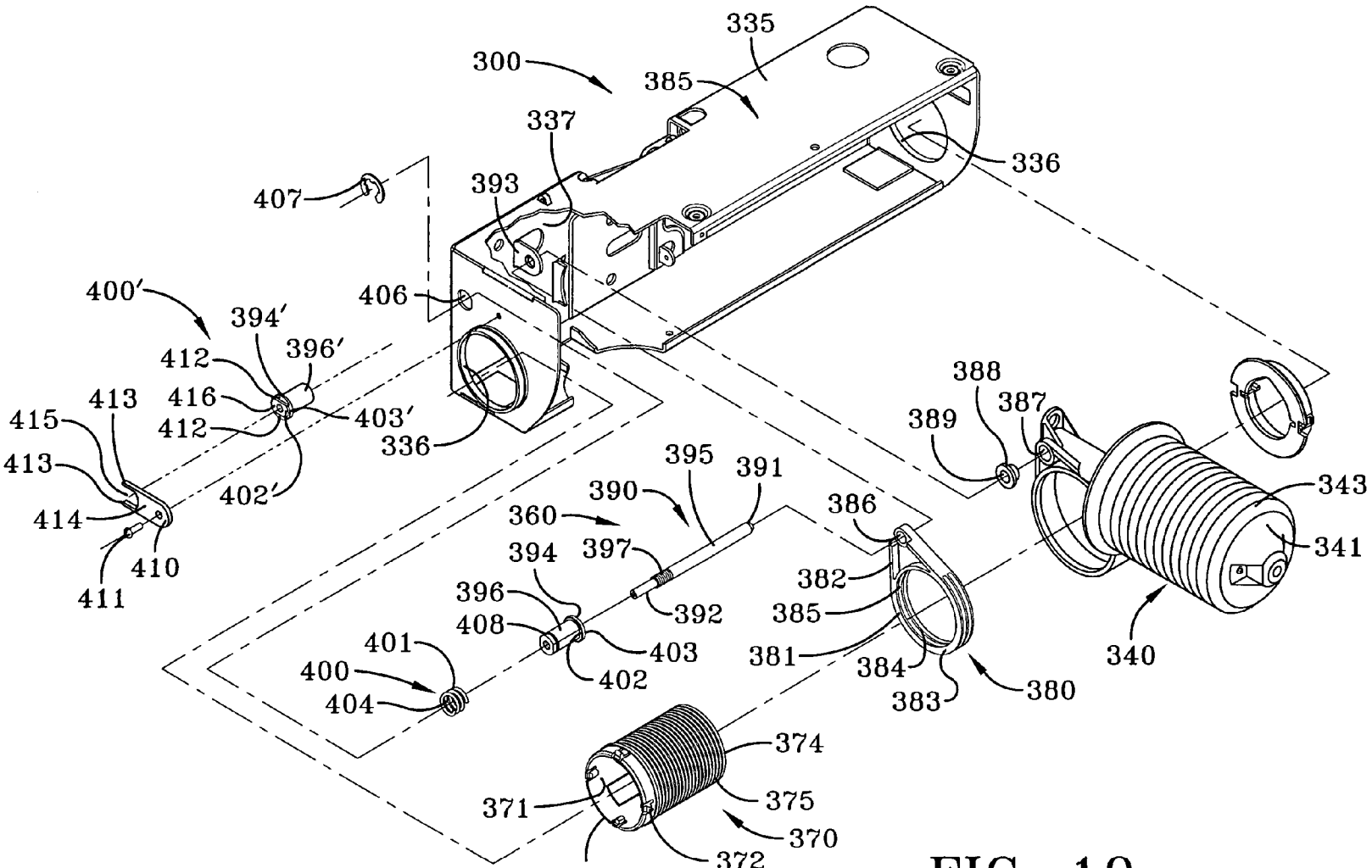
FIG. 10 is an exploded perspective view showing details of the locking assembly of FIG. 9 including a biasing member and an alternate form of biasing member.

Referring now to FIGS. 9-12, counterbalance assembly 331 has an alternative motor restraining assembly, generally indicated by the numeral 360, which may include a restraint sleeve, generally indicated by the numeral 370, mounted on counterbalancing system 330 and located between housing 335 and motor assembly 340. As best seen in FIG. 10, the locking sleeve 370 has a generally cylindrical inner surface 371 that is adapted to receive the counterbalance tube 331. Locking sleeve 370 may be provided with at least one radially extending tab 372. The tabs 372 are located at one end 373 of the locking sleeve 370 and may be made to expand outwardly of aperture 336, when assembled, to axially fix the locking sleeve 370 relative to the housing 335. The outer surface 374 of locking sleeve 370 is provided with a plurality of threads 375.

A locking actuator, generally indicated by the numeral 380, interrelates with the locking sleeve 370 to control release of motor assembly 340. The locking actuator 380 includes a locking cuff 381. As shown, the locking cuff 381 is a generally teardrop-shaped member, with a triangular projection 382 extending from a ring-shaped receiver 383 that receives the locking sleeve 370. The inner surface 384 of the ring-shaped receiver 383 has internal threads 385 which matingly engage the threaded outer surface 374 of locking sleeve 370. The locking cuff 381 seats between the housing 335 and the motor assembly 340.

The triangular projection 382 of locking cuff 381 includes a cylindrical opening 386 axially aligned with a corresponding opening 387 on the motor assembly 340. An annular receiver 388 may be seated within opening 387 and provided with a collar 389. A locking rod, generally indicated by the numeral 390, is received in the openings 386, 387 and supported at one end 391 by the receiver 388 and/or a bracket 393 extending from housing 335 and at an opposite end 392 by the housing 335. The locking rod 390 is axially movable to selectively engage and disengage the motor assembly 340. Rod 390 may be provided with a collar 394 that projects radially of the outer surface 395 of rod 390 such that the opening 386 in triangular portion 382 of bracket 381 is slidable over an outer surface 395 of rod 390, but bracket 381 exerts an axial force on rod 390 upon contacting collar 394 causing selective axial displacement of locking rod 390. While collar 394 may be formed integrally with or attach directly to rod 390, collar 394 may be provided on a plug 396 that attaches to rod 390, for example by threads 397.

To locate the rod 390 in a biased position (FIG. 11), in this case into engagement with opening 387 in motor housing 340, a biasing member, generally indicated by the numeral 400, operatively engages locking rod 390. Referring to FIG. 10, one embodiment of the biasing member 400 is shown as a coil spring 401 axially aligned with rod 390 and fitting over plug 396. In the embodiment shown, the collar 394 of plug 396 is located such that it is capable of contacting coil spring 401 on a first side 402 and locking cuff 381 on a second side 403. The coil spring 401 may be sized to allow axial movement of plug 396 through the bore 404 thereof and is interposed between the roller 394 and housing 335. Also, as shown in FIG. 9, the plug 396 may pass through an opening 406 formed in the housing 335. A lock ring 407 may then be fitted into a groove 408 of plug 396 to restrict axial movement of the rod 390. For example, in the embodiment shown in FIGS. 11 and 12, the lock ring 407 restricts the extent of entry of rod 390 into opening 387 in motor housing 340.

In another embodiment, biasing member 400' comprises a leaf spring 410 that biases rod 390 to an engaged position as described above. As shown in FIG. 10, leaf spring 410 may be located externally of housing 335 and attached thereto by a fastener 411. In accordance with this embodiment, collar 394' is located outside of housing 335 and provided with a pair of axial notches 412, 412 that receive a pair of arms 413, 413 extending from body 414 of leaf spring 410. Arms 413 define a generally C-shaped opening 415 that receives a portion 416 of the end of collar 394' between notches 412, 412. In this way collar 394' is capable of contacting the spring 410 on a first side 402' of the collar 394' and the housing 335 on a second side 403' of the collar 394' causing collar 394' to restrict the depth of entry of rod 390 into motor assembly 340.

As in the coil spring embodiment, collar 394' is attached or formed integrally with rod 390. Further, the collar 394' may be located on a plug 396' that is attachable to rod 390. Plug 396' is moveable axially and penetrates housing 335 through opening 406. Plug 396' extends radially of the outer surface 395 of rod 390. During operation of operator 300, the leaf spring 410 biases rod 390 into engagement with motor assembly 340. The rotation of locking sleeve 370 causes the cuff 381 to contact plug 396' forcing the plug 396' to move axially against the force of spring 410. Accordingly, rod 390 is axially displaced and is disengaged from or moved out of engagement with motor assembly 340. Upon reversal of the counterbalance system 330, biasing member 400' drives rod 390 into engagement with motor assembly 340 to positively lock motor assembly 340 in the operating position. It will be appreciated that rod 390 may be similarly moved in and out of engagement with motor assembly 340 by directly coupling rod 390 to locking actuator 380 such that axial movement of actuator 380 causes axial movement of rod 390.

Figure 11:
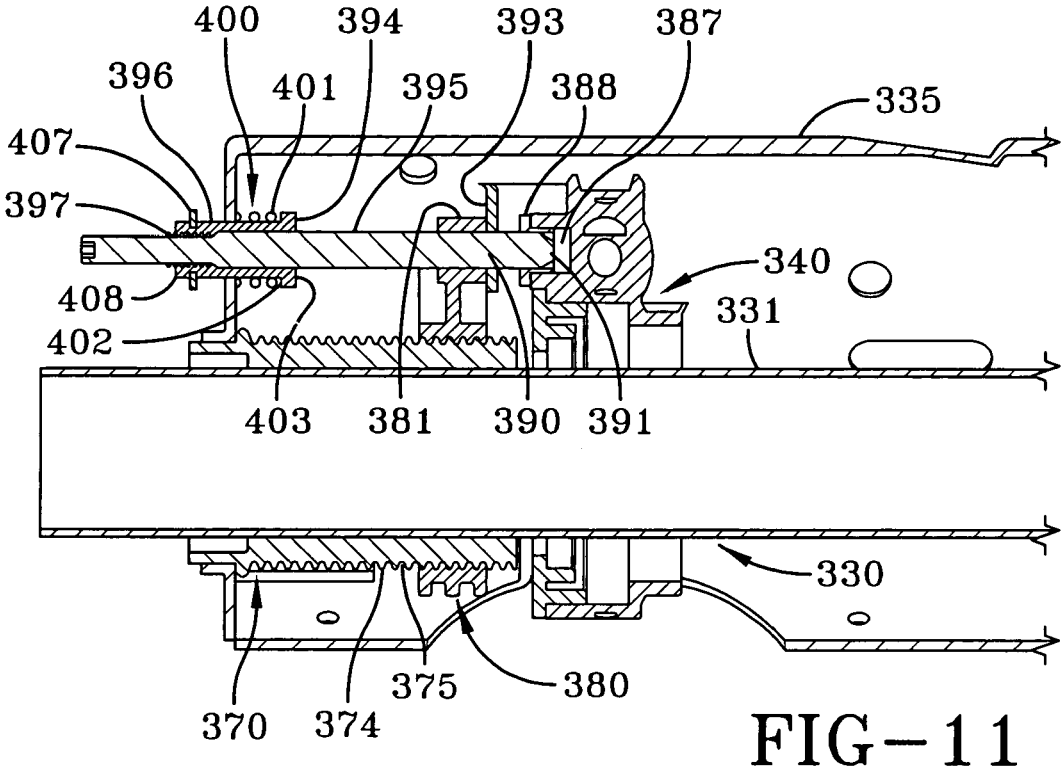
FIG. 11 is a sectional view of the modified form of locking assembly taken substantially along the line 11-11 of FIG. 9 showing details of the biasing member having moved the disconnect rod to engage the motor assembly.
Figure 12:
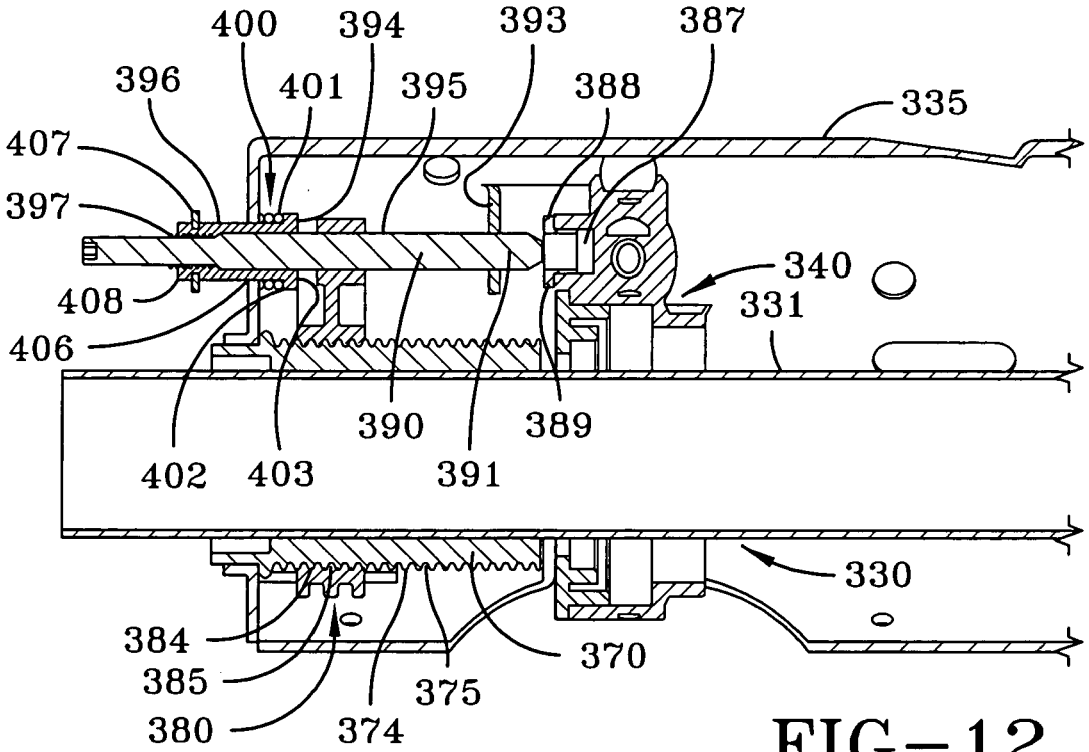
FIG. 12 is a sectional view similar to FIG. 11 showing the locking rod out of engagement with the motor assembly preparatory to pivoting the motor to lock the door.

During the normal operating cycle, the locking actuator 380 is positioned as shown in FIGS. 9 and 11 with the disconnect sleeve 370 engaging the counterbalance system 330. As elevation of the door D to an open position is commenced, locking rod 390 is biased into opening 387, as shown in FIG. 11, to positively lock the motor assembly 340 in the operating position. As shown, rotation of the locking sleeve 370 with the counterbalance tube 33 causes axial movement of locking actuator 380. As the door D is elevated, the motor assembly is held in operating position by the rod 390. At the end of the closing cycle, the locking actuator 380 causes axial movement of the rod 390 retracting 390 from the motor housing 340 (FIG. 12). At this point the torsional forces of the motor 341 cause the motor assembly 340 to rotate to a locked position, as described in the previous embodiments.

Figure 13:
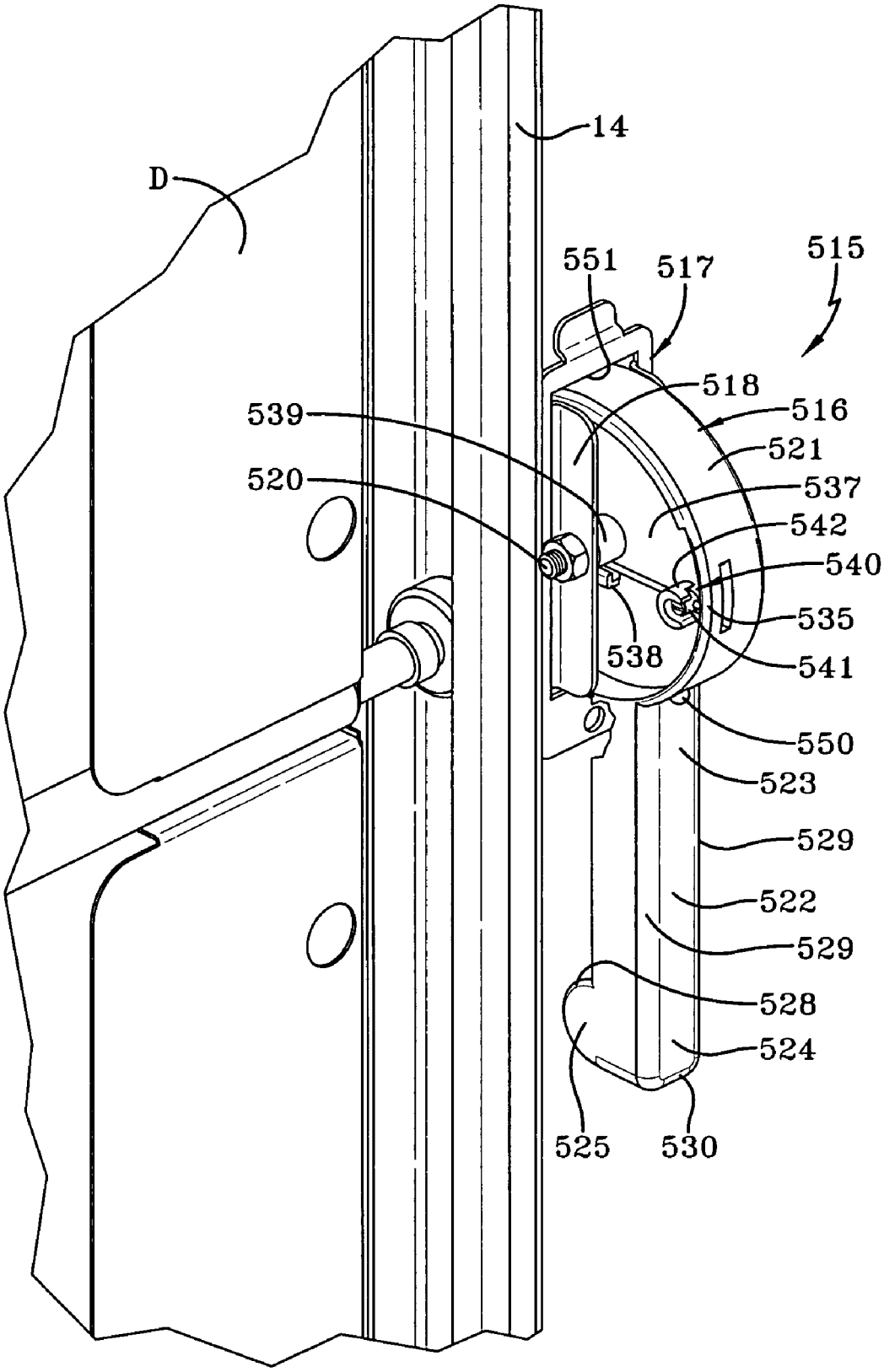
FIG. 13 is an enlarged fragmentary portion of the sectional overhead door installation of FIG. 1 shown from behind the door outwardly and showing details of the structure of an alternative handle assembly in a manual disconnect assembly.
Figure 14:
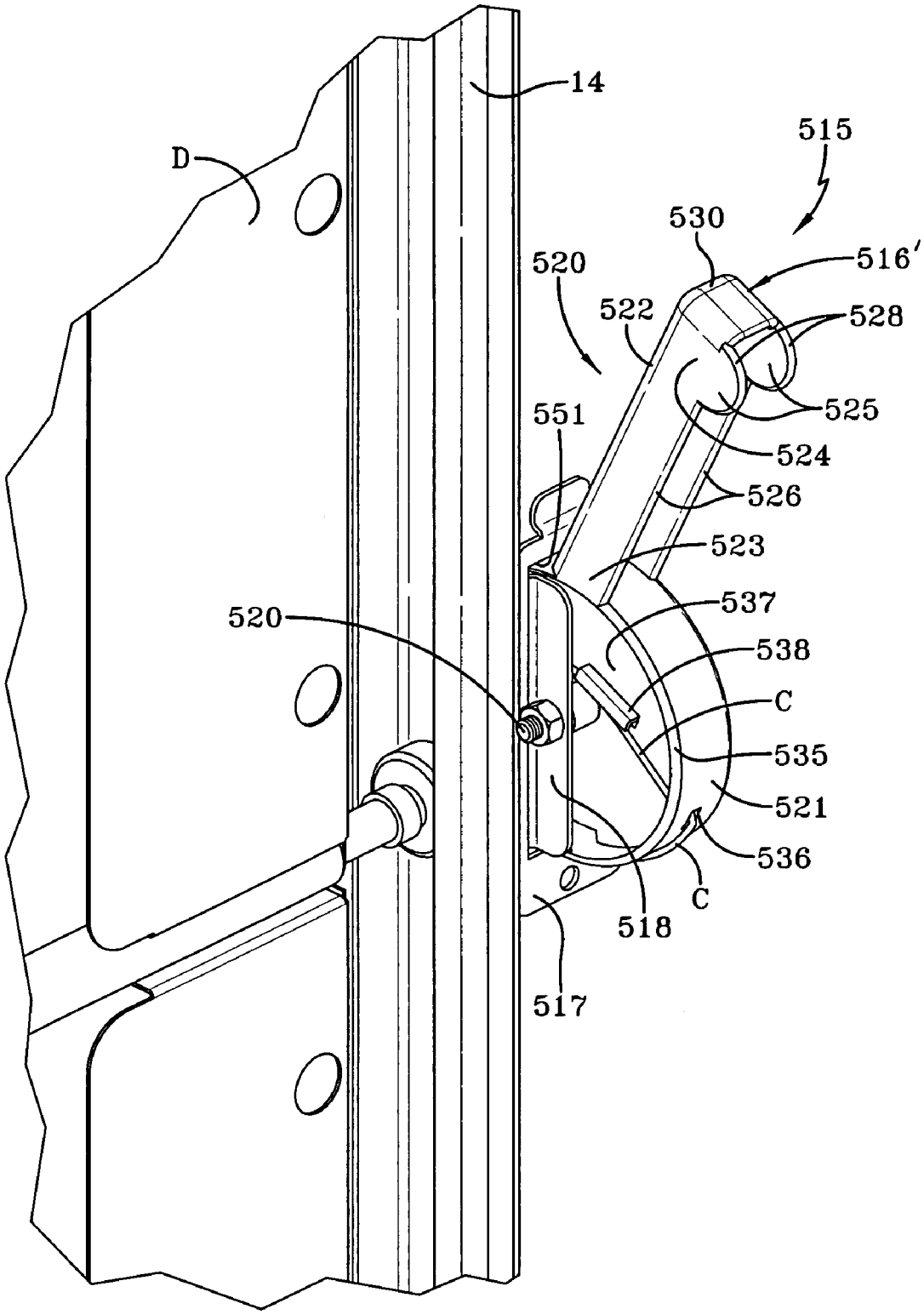
FIG. 14 is an enlarged fragmentary portion similar to FIG. 13 with the handle assembly moved to disconnect the motor assembly from the counterbalance system.
Figure 15:
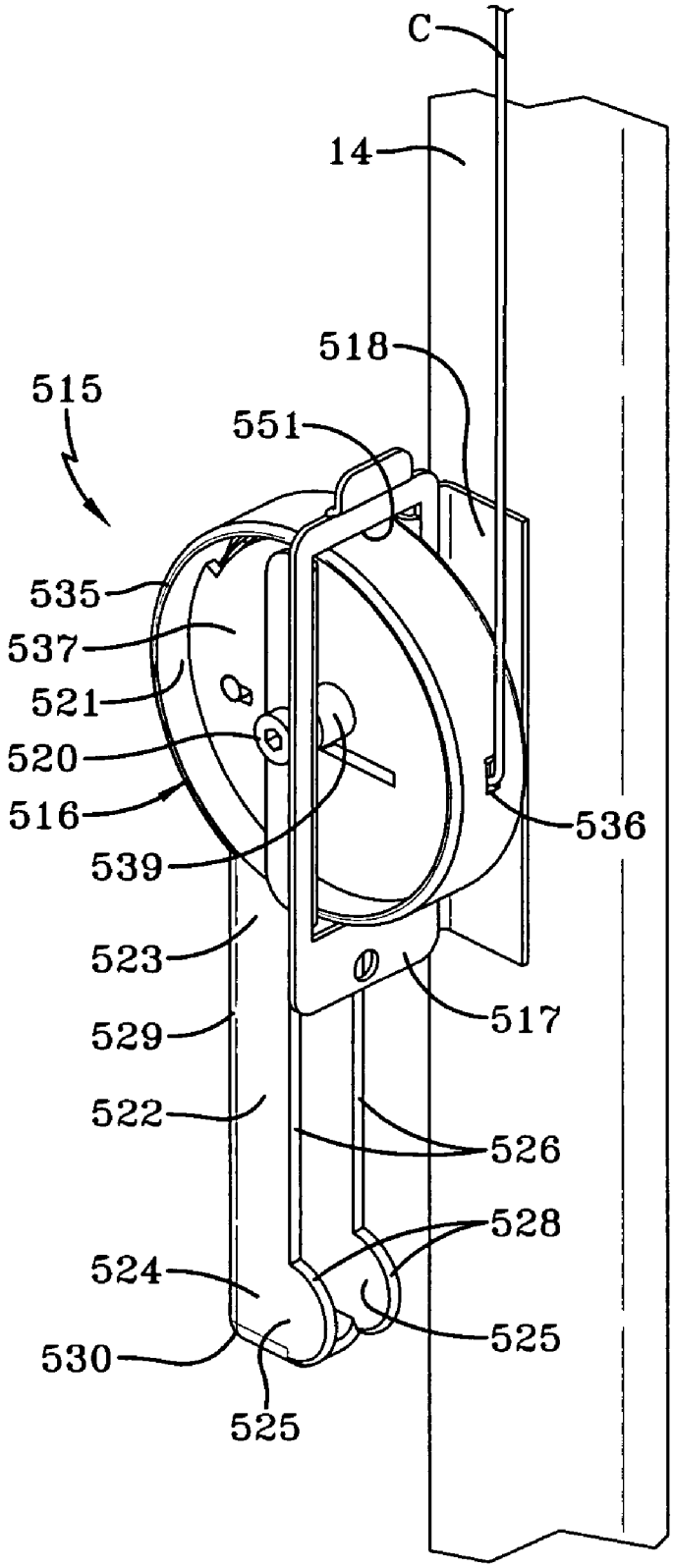
FIG. 15 is an enlarged fragmentary portion similar to FIG. 13 viewed from outside the door inwardly to show additional details of the handle assembly.

An alternative handle assembly, shown in FIGS. 13-15 and generally indicated by the numeral 515, performs similarly to handle 115, previously described, selectively tensioning cable C to disconnect motor assembly 40 from counterbalance system 30. Handle assembly 515 includes a handle 516 and a bracket 517 receiving a portion of handle 516 having a plate 518 which may be affixed to a door jamb 14 as by a cap screw or other suitable fastener. Handle assembly 515 is preferably placed at a location which is convenient for disconnecting the door D but sufficiently displaced from windows, in the door D or in the garage structure, to preclude actuation of the handle assembly 515 by a potential intruder outside the garage. Handle assembly 515 may further include a bolt 520 passing through bracket 517 and handle 516 attaching to plate 518 to provide a shaft about which handle 516 is freely rotatable to an operational position, where the motor assembly 40 engages counterbalance system 30, and a disconnect position, where motor assembly 40 has been disengaged by the operation of handle 516. The handle 516 includes a spool portion 521 for taking up cable C during actuation of handle 516 toward the disconnect position and a grip portion 522 extending radially outwardly from spool portion 521, as shown, providing a portion of handle 516 that is more easily grasped by a user and which may supply additional leverage to operate handle 516. Grip portion 522 may be of any suitable length, shape, or size to provide such leverage and graspable surfaces and may be formed integrally with spool portion 521. In the embodiment shown, grip portion 522 is a generally channel-like member extending generally radially outward from spool portion 521 at a first end 523 and terminating at a second end 524. At least one projection 525, 525 may extend inwardly toward the jamb 14 spacing grip portion 522 therefrom. As best shown in FIGS. 2 and 15, a pair of projections 525, 525 extend from the walls 526, 526 of the channel-like grip portion 522 at second end 524 to facilitate grasping of handle 516. Several of the surfaces of grip portion 522 are rounded to provide greater comfort to the user including the edge 528 of projections 525, 525, the grip portion's shoulders 529, 529, and the butt 530 of grip portion 522. Also, the edge 528 of projections 525, 525 may be made generally semicircular to allow the user to operate handle 516 by this portion of the grip 522, if so desired. Also, when the grip portion 522 is raised extending inwardly into the garage to a greater extent, the rounded and semicircular edge 528 is less likely to catch or snag on articles within the garage (FIG. 14).

Spool portion 521 may include a generally cylindrical wall 535, which is provided with a slot 536 or other suitable opening for receipt of cable C. A circular web 537 substantially spans interior of the cylindrical wall 535 and has a bored collar 539 extending axially outward from web 537 and receiving bolt 520 therethrough. A cable guide 538, which, as shown, may be a generally L-shaped member extends axially inwardly from web 537 beneath cable C to guide the cable C when any loss of tension occurs, such as, during rotation of the handle 516 from the disconnect position (FIG. 14) to the operational position (FIG. 13).

Web 537 may further be provided with a cable-securing assembly, generally indicated by the numeral 540, which conventionally may be a post, loop, hook, or other member to which the cable is secured. As shown in FIG. 13, the cable-securing assembly 540 has a cable stop 541 fixedly attached proximate an end of cable C and, then, seated within a retainer 542 to restrict axial movement of the cable C relative to the cable stop 541. From retainer 542 Cable C is routed over cable guide 538 and through slot 536 to exit the interior of spool portion 521 (FIG. 15). The cable C is then routed to the disconnect actuator 80 as described in the previous embodiment.

As best shown in FIG. 15, when the handle 516 is in the operational position, the cable C exits slot 536 substantially tangentially to the exterior surface of cylindrical wall 535. To further tension cable C causing disengagement of the motor assembly 40 from counterbalance system 30, the handle 516 is rotated about bolt 520 such that it attains a disconnect position 516' shown in FIG. 14. As the handle 516 is urged toward the disconnect position, a length of cable C is drawn around the spool portion 521, which correspondingly urges actuator 80 toward the disconnect position, as previously described. Once handle 516 has been rotated to the disconnect position 516' (FIG. 14), handle 516 may be locked in this position as by a detent 550 or other suitable locking member. As best seen in FIG. 13, detent 550 may be located proximate first end 523 of grip portion 522 and the spool portion 521, such that the detent 550 engages an edge 551 of bracket 517 when grip portion 522 nears contact with bracket 517. To effect locking of handle 516, detent 550 flexes beneath edge 551 of bracket 517 as the detent 550 is urged past edge 551. Once beyond edge 551, detent 550 rebounds or "snaps" to its unflexed position behind edge 551 creating a positive stop against rotation of handle 516' toward the operative position. The interaction of detent 550 with edge 551 of bracket 517 also serves to indicate release of the door D with an audible click or by vibration through handle 516.

To disconnect motor assembly 40, grip portion 522 may be grasped and urged upward causing rotation of spool portion 521 about bolt 520 drawing the cable C around at least a portion of the circumference of spool portion 521 increasing the tension on cable C to cause movement of actuator 80 as previously described. Eventually, handle assembly 515 fully disconnects motor 40 from counterbalance system 30 with handle 516 attaining a disconnect position 516' shown in FIG. 14. The handle 516 may be further rotated to cause detent 550 to engage the edge 551 of bracket 517 locking the handle 516 in the disconnect position 516'. Thus, in the disconnect position of handle 516, the operator motor assembly 40 is in the operating position and the drive assembly 55 has disconnected the motor 41 and the drive tube 31 such that the door D can be freely manually raised or lowered as assisted by the counterbalance system 30.

It is to be appreciated that operator motor assembly 40 may assist in seating the door D in the fully closed position, if necessary. In some, particularly low headroom, arrangements of doors, tracks and rollers, there may be instances where the top panel is not fully seated when the door is ostensibly in the closed position. In such cases, the rotation of operator motor assembly 40 may be employed to fully seat the top panel P of door D in the closed position preparatory to assuming the locked position.

When the door D and operator motor assembly 40 are actuated to effect opening of the door D, the operator motor assembly 40 rotates from the locked position to the operating position prior to movement of the door D. As the operator motor assembly 40 approaches the operating position, the spring loaded plunger 132 engages cylindrical stop 140 and depresses spring 133 until the force of plunger 132 and the rotation of the operator motor assembly move operator motor assembly 40 into the operating position secured by motor retaining assembly 130. Thereafter continued actuation of motor 41 proceeds in normal opening of the door D with the operator motor assembly 40 remaining in the operating position during the opening and closing sequence until the door D again reaches the closed position as described hereinabove.

During the normal operating cycle the disconnect actuator 80 is positioned as shown in FIG. 2 with the disconnect sleeve 70 engaging the worm wheel 54. Should an obstruction be encountered during lowering of the door D, the handle 116,516 may be moved from position 116,516 to the second position 116',516' to move disconnect plate 90, disconnect actuator 80 and thus the disconnect sleeve 70 from the engaged position with worm wheel 54 to the disengaged position. Thus disengaged from operator motor assembly 40, the door D may be freely raised or lowered manually until such time as the handle 116,516 is released from the second position 116',516' and allowed to resume the first, position, thereby engaging the disconnect sleeve 70 with worm wheel 54. The operator motor assembly 40 may be provided with a mercury switch S (FIG. 2) or other indicator to signal rotation of the motor 41 from the operating position as a secondary indicia of contact with an obstruction when the door D is not in the closed position.

It is to be appreciated that the handle assembly 115, 515 may be actuated from the first position to the second disengaged position when the door D is in the closed position. In such instance, it is to be noted that the cable C will manually effect both a pivoting of the operator motor assembly 40 from the locked position to the operating position and disengagement of disconnect sleeve 70 from worm wheel 54 such that the door can be manually raised and manipulated as necessary, as in the event of a power loss. Further, it will be appreciated that handle assembly 115, 515 may be arbitrarily located at any position desired within the structure by accordingly routing Cable C.

Figure 17:
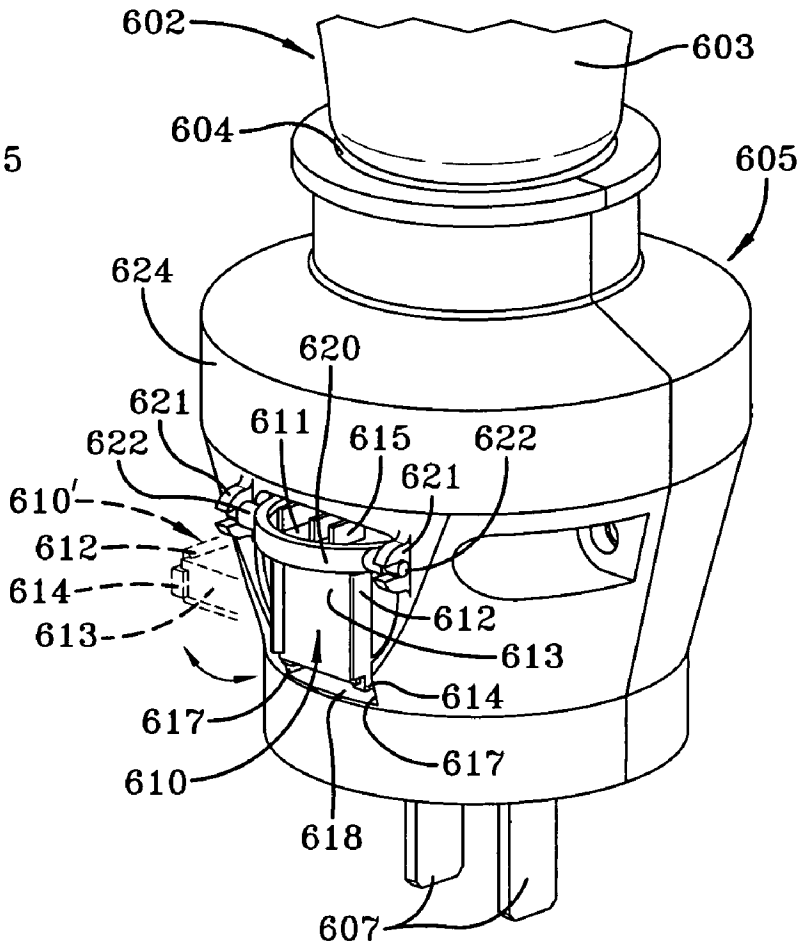
FIG. 17 is an enlarged fragmentary portion similar to FIG. 16 with the receiver assembly depicted in a stowed position in solid lines and a signal receiving position in chain lines.
Figure 16:
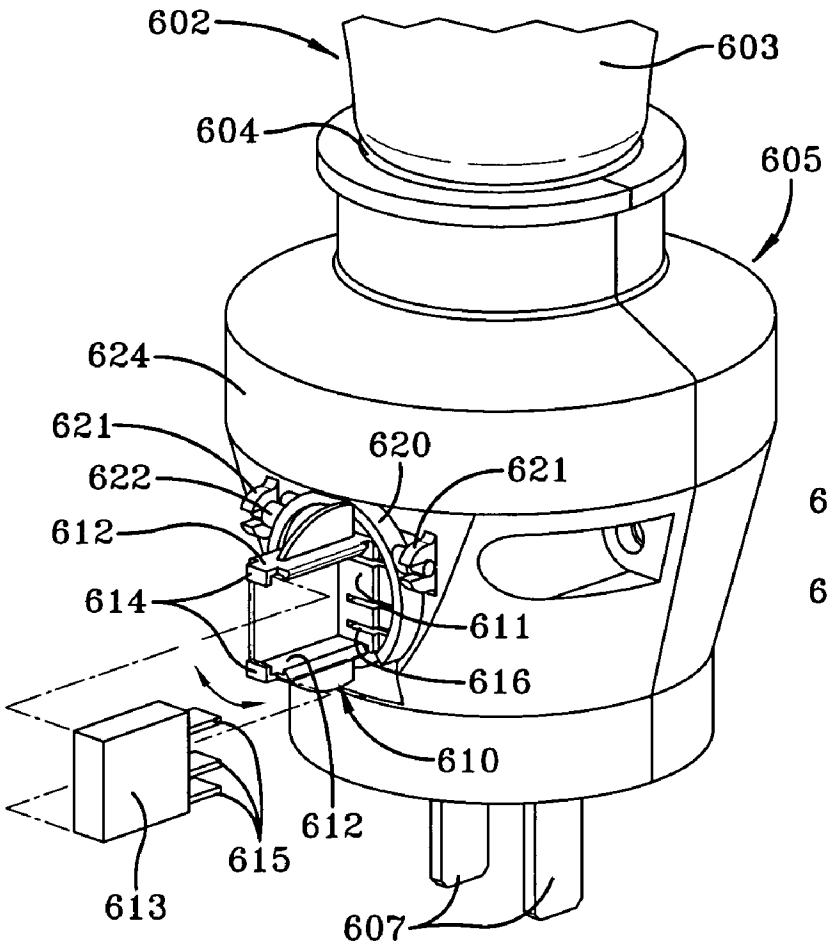
FIG. 16 is an enlarged fragmentary portion of the remote light assembly shown in FIG. 1 having a receiver assembly depicted in a receiving position.

Door operating system 10 may include a remote light assembly, generally indicated by the numeral 600 in FIGS. 1, 16 and 17, that is in communication with the operator motor such that operation of the motor activates the remote light assembly. Remote light assembly 600 is in electrical communication with a power supply, represented by an outlet 601 powering a light source 602 such as a lightbulb 603. Conventionally, lightbulb 603 may be received in a socket 604 located within a base assembly, generally indicated by the numeral 605, and connected to outlet 601 as by a plug 607. Plug 607 may be located at any point on the base and preferably extends axially outwardly therefrom opposite socket 604. To allow rotation of the base assembly 605 relative to the plane defined by the surface of outlet 601, plug 607 is journaled to base 605.

As best shown in FIGS. 16 and 17, a receiver assembly, generally indicated by the numeral 610, is located on base assembly 605 and may be gimbaled thereto to permit positioning of the receiver assembly 610 for reception of a signal S when light assembly 600 is mounted in various positions within the garage. The receiver assembly 610 generally includes a base portion 611 that has a pair of arms 612, 612 extending outwardly therefrom and a sensing element 613 supported on arms 612, 612. Inwardly facing L-shaped jaws 614, 614 formed on the ends of arms 612, 612 grasp sensing element 613 selectively securing element 613 to receiver assembly 610. As best shown in FIG. 16, sensing element 613 is received between arms 612, 612 and electrically connected to the base assembly 605 as by prongs 615 that penetrate base portion 611 at slots 616. In this way, a defective or worn sensing element 613 may be easily replaced by removing sensing element 613 from the grasp of jaws 614 and pulling prongs 615 from slot 616. As best shown in FIG. 17, when in a stowed position within base assembly 605 shown in solid lines in FIG. 17, sensing element 613 has been rotated and pivoted such that sensing element 613 is substantially parallel to the side walls 617, 617 of base assembly 605 and is received in the recess 618 defined between walls 617, 617. In the stowed position (FIG. 17) prongs 615 are not in electrical communication with the base portion 605. To ready the receiver assembly 610 for operation, receiver assembly is pivoted to an extended position 610', shown in chain lines and described more completely below. When in the extended position 610', prongs 615 make electrical contact within base assembly allowing sensing element 613 to control illumination of lightbulb 603.

An annular gimbal member, generally indicated by the numeral 620, pivotally attaches to base assembly 605 as by ears 621, 621 extending from base assembly 605 receiving opposed spindles 622, 622 extending radially outward from gimbal 620. Gimbal 620 receives base portion 611, as by an interference fits such that base portion 611 may rotate within annular gimbal 620. Receiver assembly 610 may be urged from a first or stowed position, within base assembly 605 toward a second or receiving position 610' shown in broken lines, where the sensing element 613 extends outwardly of a side 624 of base assembly 605 by pivoting base portion 611 with gimbal 620 about spindles 622. As indicated by arrows, gimbal 620 allows sensing element 613 to be rotated in the plane defined by base portion 611 and/or pivoted about spindles 622 to optimally receive a signal S from operator 10 (FIG. 1).

Operator 10 includes a transmitter, generally indicated by the numeral 625, located within or on operator 10 to transmit a signal S, as by a radio frequency or infrared emitter, to receiver assembly 610. As shown in FIG. 1, transmitter 625 may be located rearwardly of operator 10 such that signal S is directed inwardly within the garage. Transmitter 625 may also be placed within the cover of operator 10 and transmit signal S through the operator cover or an opening formed therein. Transmitter 625 is in operative communication with operator 10 such that transmitter 625 is activated during the operating cycle of motor 41 directing signal S toward receiver assembly 610. Upon receipt of the signal S, sensing element 613 assumes an on condition effecting illumination of lightbulb 603. If desired, either transmitter 625 or receiver assembly 610 may be preset to illuminate lightbulb 603 for a period of time after the system 10 has stopped operation of the motor 41.

Thus, it should be evident that the overhead door locking operator disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A system for raising and lowering a sectional overhead door between an open position and a closed position comprising: a counterbalance system adapted to be connected to the door, and an operator motor assembly mounted proximate to the sectional overhead door in the closed position of the sectional overhead door and operating said counterbalance system for raising and lowering the door, characterized in that at least a portion of said operator motor assembly is moveable between a door operating position and a door locking position and, in the locking position, said portion of said operator motor assembly is positioned in the path of travel of the door from the closed to the open position, to impede opening of said door.

2. The system according to claim 1, wherein said portion of said operator motor assembly is pivotally mounted for movement between said door operating position and said door locking position.

3. The system according to claim 1, further comprising a disconnect for selectively connecting said operator motor assembly and said counterbalance system and disconnecting said operator motor assembly and said counterbalance system.

4. The system according to claim 3, further comprising an actuator operative to both disconnect said operator motor assembly and said counterbalance system and move said operator motor assembly from said door locking position to said door operating position, whereby the door may be manually raised from the closed position.

5. The system according to claim 3, wherein said disconnect comprises a disconnect actuator mechanically activated to allow manual movement of the door including a handle assembly and cable operatively interconnected with said disconnect actuator, said handle rotatable to operatively tension said cable to disconnect said motor assembly from said counterbalance system.

6. The system according to claim 5, further comprising an anti-intrusion mechanism associated with said actuator.

7. The system according to claim 1, further comprising a switch associated with said operator motor assembly for signaling movement of said operator motor assembly from said operating position toward said door locking position when the door is not in the closed position.

8. The operator according to claim 7, wherein said portion of said operator motor assembly carries a plunger which is adapted to engage a fixed stop.

9. The system according to claim 1, further comprising a retaining assembly to secure said portion of said operator motor assembly in said door operating position during the normal operating torque range attendant the moving of the door in the upward and downward directions.

10. The system according to claim 1, further comprising a locking actuator operatively attached to the counterbalancing system, said locking actuator causing extension or retraction of a rod to engage and disengage said portion of said operator motor assembly.

11. The system according to claim 10, further comprising a locking sleeve attached to said counterbalance system for rotation therewith and having a threaded outer surface, said locking actuator including a cuff having threads matingly engaging said threaded outer surface of said locking sleeve such that rotation of said locking sleeve causes axial movement of said locking actuator to selectively cause extension and retraction of said rod.

12. The system according to claim 11, further comprising a biasing member urging said rod toward at least one of said engaged positions.

13. The system of claim 12, further comprising a collar attached to said rod located between said locking actuator and said biasing member, whereby said biasing member and said actuator act upon said collar to axially position said rod.

14. A system according to claim 1 further comprising a retaining assembly for maintaining said operator motor assembly in said door operating position during normal raising and lowering of the door.

* * * * *